US009517622B2

(12) United States Patent
Kuramochi et al.

(10) Patent No.: US 9,517,622 B2
(45) Date of Patent: Dec. 13, 2016

(54) LIQUID DROPLET FORMING APPARATUS

(71) Applicants: Yuzuru Kuramochi, Tokyo (JP); Yoshio Uchikata, Kanagawa (JP); Daisuke Takagi, Kanagawa (JP); Manabu Seo, Kanagawa (JP)

(72) Inventors: Yuzuru Kuramochi, Tokyo (JP); Yoshio Uchikata, Kanagawa (JP); Daisuke Takagi, Kanagawa (JP); Manabu Seo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/969,236

(22) Filed: Dec. 15, 2015

(65) Prior Publication Data

US 2016/0176191 A1 Jun. 23, 2016

(30) Foreign Application Priority Data

Dec. 22, 2014 (JP) ..... 2014-259121
May 29, 2015 (JP) ..... 2015-109677
Oct. 9, 2015 (JP) ..... 2015-200822

(51) Int. Cl.
*B41J 2/14* (2006.01)

(52) U.S. Cl.
CPC ..... *B41J 2/14233* (2013.01); *B41J 2/14201* (2013.01); *B41J 2202/15* (2013.01)

(58) Field of Classification Search
CPC .. B41J 2/14201; B41J 2/14233; B41J 2/14298
See application file for complete search history.

(56) References Cited

U.S. PATENT DOCUMENTS 5,650,802 A 7/1997 Suzuki et al.
6,338,545 B1 1/2002 Sekiya
6,629,646 B1 10/2003 Ivri
6,712,455 B2 * 3/2004 Dante ..... B41J 2/14201 347/68

(Continued)

FOREIGN PATENT DOCUMENTS

JP S59-230659 12/1984
JP H06-087220 3/1994

(Continued)

OTHER PUBLICATIONS

Watari Atsushi, "Kikai Shindo", Maruzen, pp. 62-65.

(Continued)

*Primary Examiner* — Geoffrey Mruk
(74) *Attorney, Agent, or Firm* — IPUSA, PLLC

(57) ABSTRACT

There is provided a liquid droplet forming apparatus comprising: a liquid holding part configured to hold a liquid including precipitating particles; a film member configured to be vibrated so as to eject the liquid held in the liquid holding unit, wherein a nozzle is formed in the film member and the liquid is ejected as a droplet from the nozzle; a vibrating unit configured to vibrate the film member; and a driving unit configured to selectively apply an ejection waveform and a stirring waveform to the vibrating unit, wherein the film member is vibrated to form the droplet in response to applying the ejection waveform and the film member is vibrated without forming the droplet in response to applying the stirring waveform.

7 Claims, 19 Drawing Sheets

(56) References Cited

U.S. PATENT DOCUMENTS

| | | | | |
|---|---|---|---|---|
| 2003/0142170 | A1 | 7/2003 | Haluzak et al. | |
| 2007/0176952 | A1* | 8/2007 | Sekiguchi ..... | B41J 2/04551 347/11 |
| 2011/0017196 | A1 | 1/2011 | Bell et al. | |

FOREIGN PATENT DOCUMENTS

| | | |
|---|---|---|
| JP | 2006-289984 | 10/2006 |
| JP | 2007-137023 | 6/2007 |
| JP | 2013-000679 | 1/2013 |
| JP | 2013-176939 | 9/2013 |
| WO | 2008/044071 | 4/2008 |

OTHER PUBLICATIONS

M. K. Kwak, "Vibration of Circular Membranes in Contact with Water", Journal of Sound and Vibration (1994) 178(5), pp. 688-690.
Extended European Search Report dated Jun. 9, 2016.

* cited by examiner

LIQUID DROPLET FORMING APPARATUS

BACKGROUND OF THE INVENTION

1. Field of the Invention

The present disclosure relates to liquid droplet forming apparatuses.

2. Description of the Related Art

Conventionally, a liquid droplet forming apparatus that ejects liquid held in a liquid chamber as a droplet is known in the art. In the conventional liquid droplet forming apparatus, for example, dispersing liquid using a pigment as colorant is used as the liquid to be ejected.

However, in the dispersing liquid using a pigment as colorant, although the pigment does not precipitate by itself, the pigment may precipitate due to congelation caused by Van der Waals' forces, etc., when the dispersing liquid using a pigment as colorant is left in the liquid droplet forming apparatus for a long time. When coagula of the pigment precipitate, the liquid cannot be stably ejected due to a clogging nozzle. Therefore, the liquid needs to be dispersed again so as to prevent the coagulation of the pigment (for example, see Patent document 1).

Recently, a technology in which a plurality of cells are ejected using inkjet is developed as stem cell technology advances. A cell is a precipitating particle that precipitates upon being left for long time. Although conventional particles (such as the pigment) ejected by the conventional liquid droplet forming apparatus precipitate after being coagulated, the precipitating particle such as a cell may solely precipitates without being coagulated since the precipitating particle is heavier than a conventional particle having a diameter 100 times greater than a diameter of the conventional particle.

Therefore, when using a method for the conventional liquid droplet forming apparatus, it is difficult to sufficiently stir liquid including the precipitating particles, and variance in a number of the precipitating particles included in an ejected droplet may be caused due to the precipitation of the precipitating particles.

RELATED ART DOCUMENT

Patent Document

[Patent Document 1]: Japanese Unexamined Patent Application Publication No. H06-087220

SUMMARY OF THE INVENTION

An object of disclosure of the present technology is to provide a liquid droplet forming apparatus capable of reducing variance in a number of the precipitating particles included in an ejected droplet.

The following configuration is adopted to achieve the aforementioned object.

In one aspect of the embodiment, there is provided a liquid droplet forming apparatus comprising: a liquid holding part configured to hold a liquid including precipitating particles; a film member configured to be vibrated so as to eject the liquid held in the liquid holding unit, wherein a nozzle is formed in the film member and the liquid is ejected as a droplet from the nozzle; a vibrating unit configured to vibrate the film member; and a driving unit configured to selectively apply an ejection waveform and a stirring waveform to the vibrating unit, wherein the film member is vibrated to form the droplet in response to applying the ejection waveform and the film member is vibrated without forming the droplet in response to applying the stirring waveform.

Other objects, features and advantages of the present invention will become more apparent from the following detailed description when read in conjunction with the accompanying drawings.

DETAILED DESCRIPTION OF THE PREFERRED EMBODIMENTS

Figure 1:
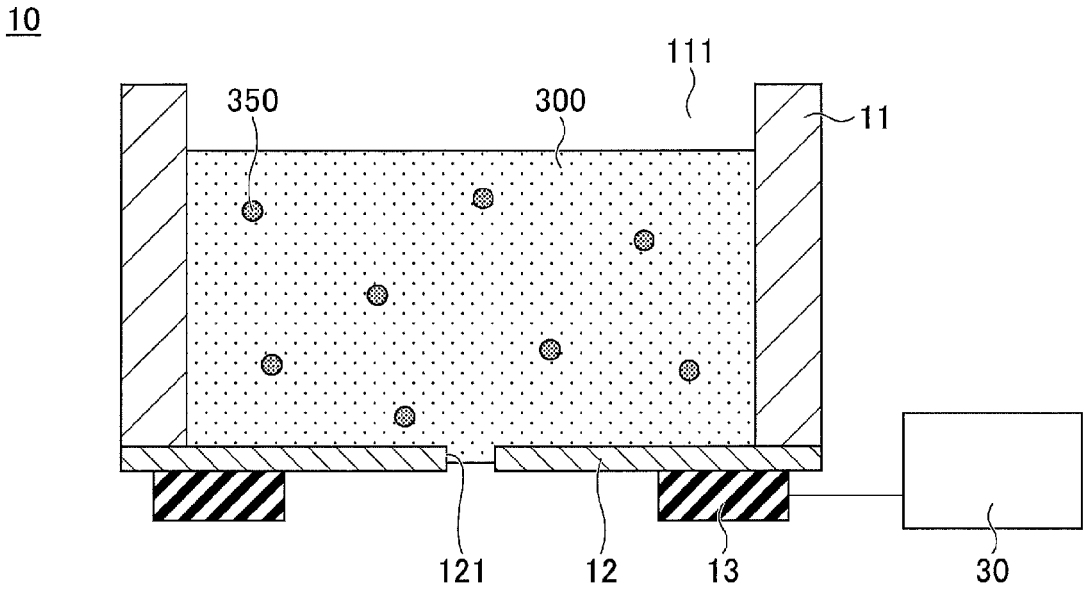
FIG. 1 is a cross sectional view of a liquid droplet forming apparatus of the first embodiment.

Herein below, embodiments will be described with reference to the accompanying drawings. Additionally, in respective embodiments (or variations), identical reference numerals will be applied to an elements or the like that have substantially similar functions and configurations to those in another embodiment (or a variation of the embodiment), and descriptions thereof may be omitted.

First Embodiment

Structure of Liquid Droplet Forming Apparatus

In the following, a first embodiment will be described. FIG. 1 is a cross sectional view of a liquid droplet forming apparatus of the first embodiment. With reference to FIG. 1, the liquid droplet forming apparatus 10 includes a liquid chamber 11, a membrane 12, a piezoelectric element 13 and a driving device 30. FIG. 1 schematically illustrates the liquid chamber 11 holding liquid (liquid solution) 300 including precipitating particles 350.

Additionally, in the present embodiment, the liquid chamber 11 side is referred to as the upper side, while the piezoelectric elements 13 side is referred to as the lower side. Also, the liquid chamber 11 side in respective portions (parts) is referred to as the upper side of the portion (part) while the piezoelectric elements 13 side in respective portions (parts) is referred to as the lower side of the portion (part). Also, a plan vision means viewing an object from the upper side of the membrane 12 in normal line direction, and a planar shape means a shape of an object viewing from the upper side of the membrane 12 in normal line direction.

In the liquid droplet forming apparatus 10, the liquid chamber 11 is a liquid holding unit for holding the liquid 300 including the precipitating particles 350 (precipitating particles 350 being dispersed), and the liquid chamber 11 can be made of metal, silicon, ceramic, and the like. The liquid chamber 11 includes an atmosphere opening part 111 for opening the inside of the liquid chamber 11 to the atmosphere, where the atmosphere opening 111 is formed in upper side of the liquid chamber 11 so that the bubbles mixed with the liquid 300 can be ejected from the atmosphere opening 111.

The membrane 12 is a film shape member fixed at the lower end of the liquid chamber 11. A nozzle 121 that is a through hole is formed in approximate center of the membrane 12, where the liquid 300 held in the liquid chamber 11 is ejected as a droplet from the nozzle 121 through vibration of the membrane 12. For example, the planar shape of the membrane 12 may be circular, ellipsoidal, rectangular, and the like.

Figure 2:
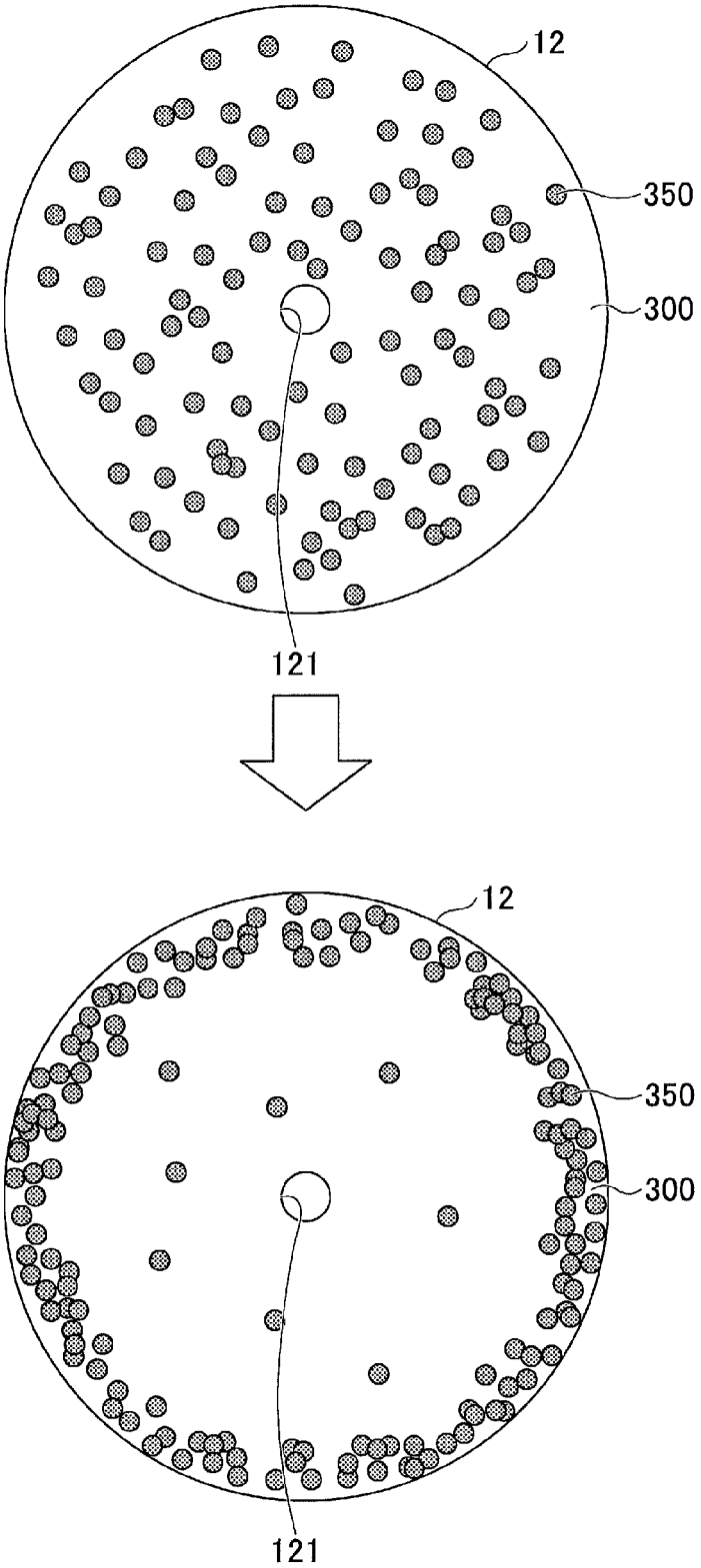
FIG. 2 is a diagram for illustrating biased accumulation of particles.

Magnitude of the vibration is smaller at outer edge portion of the membrane 12, which corresponds to a bottom surface of the liquid chamber 11, in comparison to the magnitude of the vibration at center portion of the membrane 12 since the outer edge portion of the membrane 12 is fixed at the lower end of the liquid chamber 11. Therefore, as shown in FIG. 2, precipitating particles 350 having precipitated are likely to accumulate at the outer edge portion of the membrane 12, which corresponds to the bottom surface of the liquid chamber 11. Additionally, upper side in FIG. 2 illustrates a state of the membrane 12 before the vibration while lower side in FIG. 2 illustrates a state of the membrane 12 after the vibration, where an arrow is shown between the upper side and the lower side in FIG. 2.

Figure 3A:
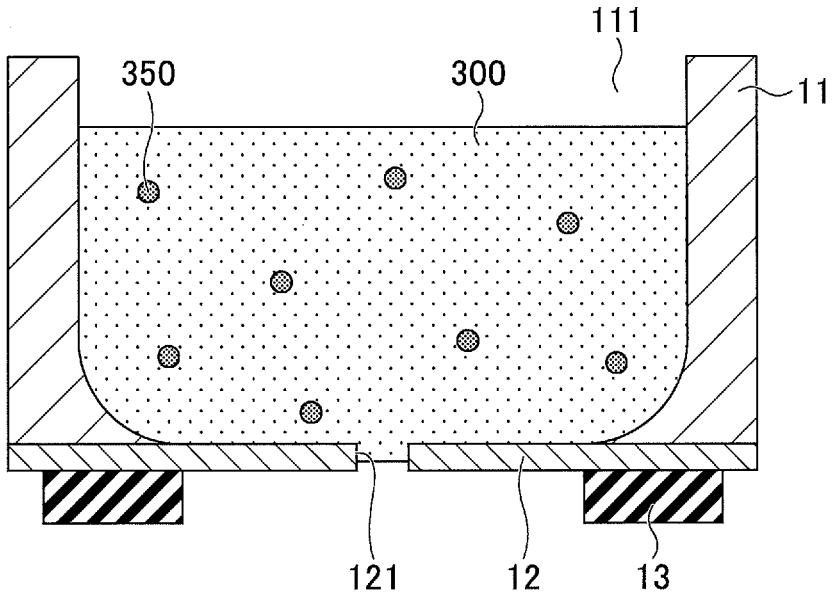
FIG. 3A is a diagram for illustrating example method for reducing biased accumulation of the precipitating particles.
Figure 3B:
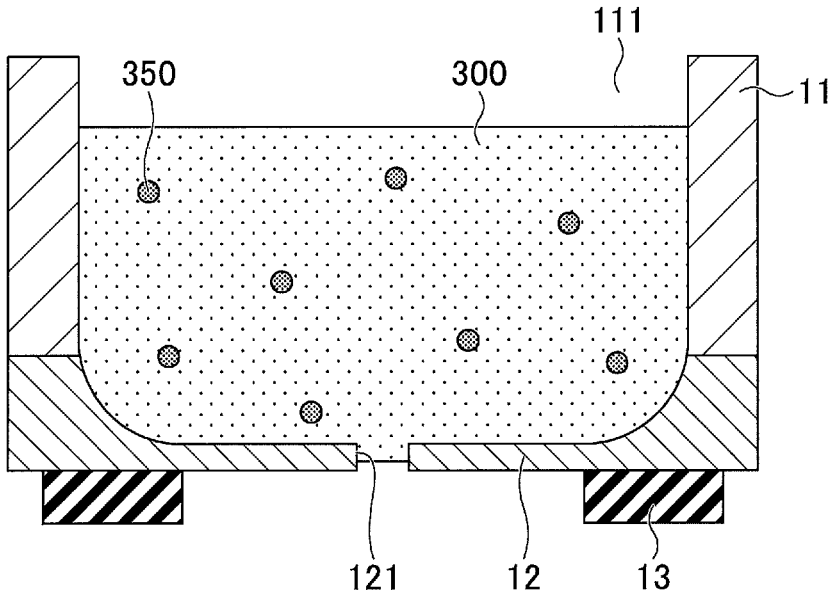
FIG. 3B is another diagram for illustrating example method for reducing biased accumulation of the precipitating particles.

FIG. 3A and FIG. 3B are diagrams for illustrating example methods for reducing biased accumulation of the precipitating particles. In FIG. 3A, inside wall shape of lower end portion of the liquid chamber 11 is curved in a cross sectional view. In FIG. 3B, shape of the outer edge portion of the membrane 12 is curved in the cross sectional view. As shown in FIG. 3A and FIG. 3B, when bottom of the liquid chamber 11 has the curved shape in which thickness of the bottom becomes greater as a position in the bottom becomes closer to the outer edge of the bottom, the biased accumulation (tendency to accumulate at the outer edge portion of the bottom surface of the liquid chamber 11) of the precipitating particles 350 can be reduced.

Materials for forming the membrane 12 are not limited. However, preferably, a material with a certain hardness is used since the membrane 12 formed of a too soft material that too easily vibrates is difficult to stop the vibration when the droplet is not ejected. For example, a metal material, a ceramic material, a polymer material with a certain hardness may be used for forming the membrane 12. Additionally, in particular, a material with low adhesiveness to the precipitating particle 350 is preferable.

Generally, adhesiveness of a cell is considered to be dependent on a contact angle of the material and water. The adhesiveness of the cell is small when the material has a high hydrophilicity or a high hydrophobicity. Various metal materials or ceramic material (metal oxide) can be used as the material with a high hydrophilicity, while fluorinated resin, etc., can be used as the material with a high hydrophobicity.

Stainless steel, nickel aluminum, silicon dioxide, alumina, zirconia, etc., can be exemplified as the material. Also, the adhesiveness of the cell can be reduced by coating a surface of the material, where the surface of the material can be coated with the aforementioned metal material, metal oxide, or synthetic phospholipid polymer (e.g., Lipidure, manufactured by NOF Corporation).

The nozzle 121 is preferably formed at an approximate center of the membrane 12 as a through hole whose shape is substantially true circular. A diameter of the nozzle 121 is not limited. However, the diameter is preferably more than twice of size of the precipitating particle 350 in order to avoid the nozzle 121 being clogged with the precipitating particles 350.

The piezoelectric element 13 is formed at the lower surface of the membrane 12. A shape of the piezoelectric element 13 may be designed in accordance with the shape of the membrane 12. For example, when the planar shape of the membrane 12 is circular, preferably, the piezoelectric element 13 is annularly (in ring-shape) formed around the nozzle 121.

For example, the piezoelectric element 13 has a structure in which a voltage is applied to an upper surface and a lower surface of piezoelectric material. When the voltage is applied to upper and lower electrodes of the piezoelectric element 13, compression stress is applied in a horizontal direction of the paper, thereby having the membrane 12 vibrate. For example, lead titanate zirconate can be used as the piezoelectric material. Also, materials of bismuth iron oxide, niobium oxide metal, barium titanate, a material created by adding metal or another oxide to the aforementioned materials, etc., may be used as the piezoelectric material.

However, a vibrator (vibrating unit) for vibrating the membrane 12 is not limited to the piezoelectric element 13. For example, the membrane 12 can vibrate due to a difference of linear expansion coefficients when a material having a linear expansion coefficient different from the linear expansion coefficient of the membrane 12 is pasted on the membrane 12 and heated. In this case, preferably, a heater is formed in the material having the different linear expansion coefficient, where the material is heated through power supply to the heater so as to vibrate the membrane 12.

The driving device 30 is provided for driving the piezoelectric element 13. The driving device 30 selectively (e.g., alternately) apply ejection waveform and stirring waveform to the piezoelectric element 13, where the ejection waveform is applied to have the membrane 12 vibrate to form the droplet and the stirring waveform is applied to have the membrane 12 vibrate without forming the droplet.

That is, the driving device 30 applies the ejection waveform to the piezoelectric element 13 to control the vibration of the membrane 12, thereby ejecting the liquid 300 held in the liquid chamber 11 as the droplets from the nozzle 121. Also, the driving device 30 applies the stirring waveform to the piezoelectric element 13 to control the vibration of the membrane 12, thereby stirring the liquid 300 held in the liquid chamber 11. Additionally, the droplets are not ejected from the nozzle 121 in the stirring.

As described above, by stirring the liquid 300 during a period in which the droplet is not formed, precipitation and coagulation of the precipitating particles 350 on the membrane 12 during the period in which the droplet is not formed can be prevented. Consequently, clogging of the nozzle 121 and variance of a number of the precipitating particles 350 in an ejected droplet can be reduced.

In the liquid 300 including the precipitating particles 350, the precipitating particles 350 may be metal fine particles, inorganic fine particles, cell (in particular, human-derived cell), and the like. Although, types of metal fine particles are not limited, silver particles, cupper particles, etc., may be used for drawing wiring with the ejected droplets.

Although, types of the inorganic fine particles are not limited, titanium oxide, silicon dioxide, etc., may be used as white ink, for coating spacer materials, and the like. As for type of the cells, animal cells (in particular, human-derived cells) are preferably used. In this case, the liquid droplet forming apparatus 10 is used as an apparatus for ejecting cells so as to form tissue fragment used in evaluating medical benefit or cosmetics.

Generally, solvent of the liquid 300 is water. However, this is not a limiting example, and various organic solvents such as alcohol, mineral oil, and vegetable oil may be used. When the water is used as the solvent, preferably, wetting agent for reducing vaporization of the water, or surface active agent for reducing surface tension is included. Materials generally used in inkjet inks can be used for formulating the aforementioned agents.

Although, amount of the liquid 300 held in the liquid chamber 11 is not limited, typically, 1 μl to 1 ml of the liquid 300 is held. Preferably, 1 μl to 50 μl of the liquid 300 is held since the droplets can be formed with small amount of the liquid 300 in a case where an expensive liquid such as a cell suspension liquid is used.

<Droplet Forming Process of Liquid Droplet Forming Apparatus>

Figure 4A:
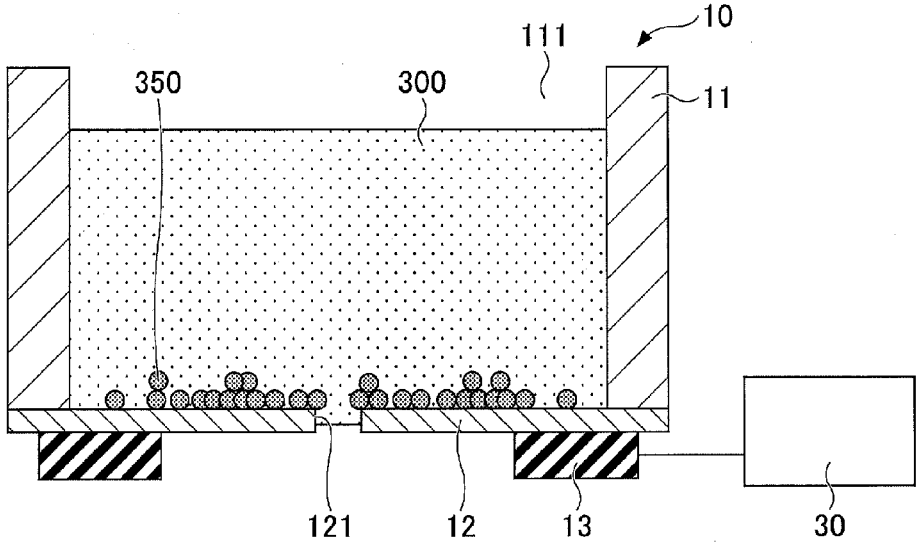
FIG. 4A is a diagram for schematically illustrating liquid including precipitating particles held and left in the liquid chamber.
Figure 4B:
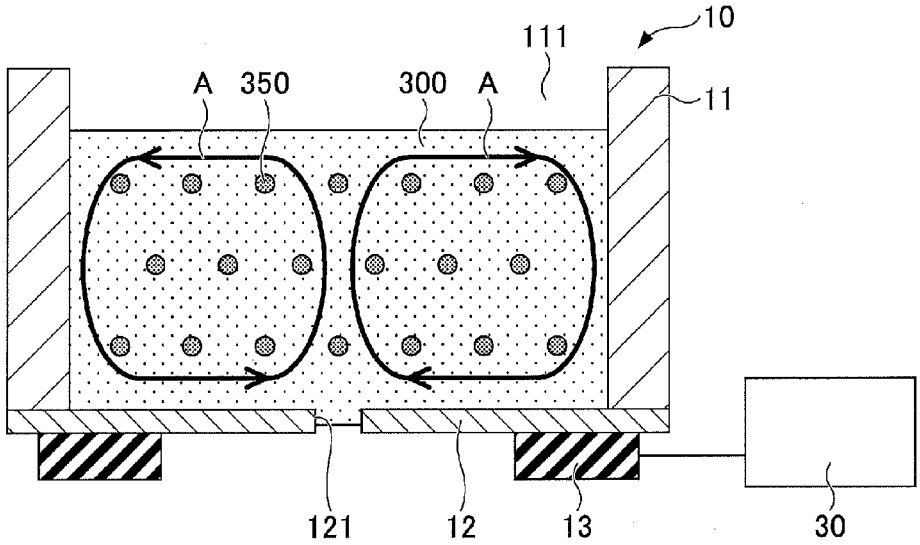
FIG. 4B is a diagram for schematically illustrating the precipitating particles stirred due to vibration of a membrane, where a driving device inputs the stirring waveform so as to have the membrane vibrate without forming the droplets.
Figure 4C:
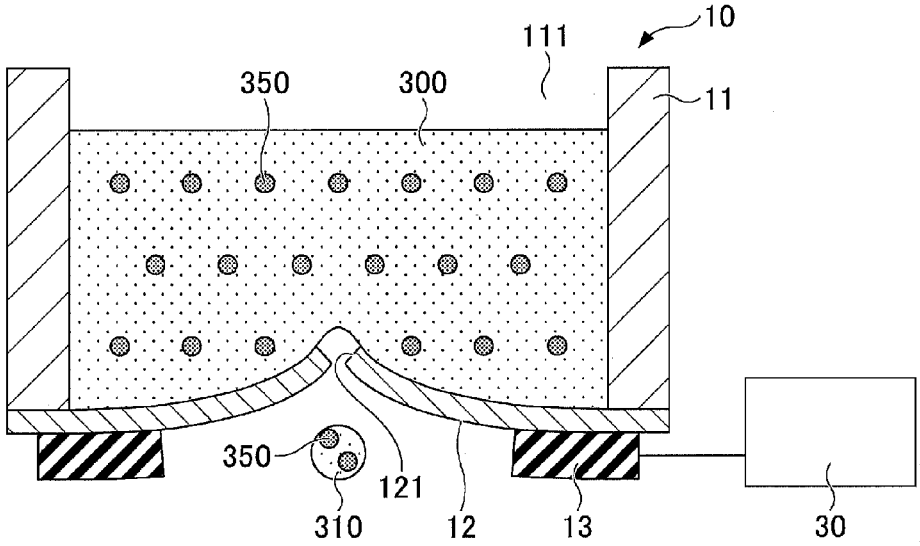
FIG. 4C is a diagram for schematically illustrating a droplet formed by the vibration of the membrane, where the driving device inputs the ejection waveform.

In the following, a droplet forming process by the liquid droplet forming apparatus of the first embodiment will be described. FIG. 4A, FIG. 4B and FIG. 4C are diagrams for illustrating the droplet forming process. FIG. 4A is a diagram for schematically illustrating the liquid 300 including the precipitating particles 350 held and left in the liquid chamber 11. At a stage shown in FIG. 4A, the precipitating particles 350 are precipitated in the bottom of the liquid chamber 11.

When a droplet forming operation is performed in a state shown in FIG. 4A, the droplet may not be formed since the precipitating particles 350 are congregated around the nozzle 121. Also, when a droplet forming operation is performed in a state shown in FIG. 4A, a great amount of the precipitating particles 350 may be ejected at once and then supernatant of the liquid 300 may be ejected. Therefore, the number of the precipitating particles 350 in the droplet may significantly vary even if the droplets can be formed.

FIG. 4B is a diagram for schematically illustrating the precipitating particles 350 stirred due to the vibration of the membrane 12, where the driving device 30 inputs the stirring waveform into the piezoelectric element 13 so as to have the membrane 12 vibrate without forming the droplets. The liquid surface around the nozzle 121 vibrates significantly due to the vibration of the membrane 12, which causes convective flows shown as arrows "A" in FIG. 4B to stir the liquid 300 including the precipitating particles 350.

FIG. 4C is a diagram for schematically illustrating the droplet 310 formed by the vibration of the membrane 12, where the driving device 30 inputs the ejection waveform into the piezoelectric element 13. When the driving device 30 applies the ejection waveform to the piezoelectric element 13 as shown in FIG. 4C after the precipitating particles 350 are dispersed in the liquid chamber 11 as shown in FIG. 4B, the droplets 310 can be formed in a manner where the numbers of the precipitating particles 350 in the respective droplets 310 are kept uniform.

The liquid droplet forming apparatus 10 can stir the precipitating particles 350 more efficiently in comparison to a conventional liquid droplet forming apparatus. This will be described in detail with reference to FIG. 5A, FIG. 5B and FIG. 6.

Figure 5A:
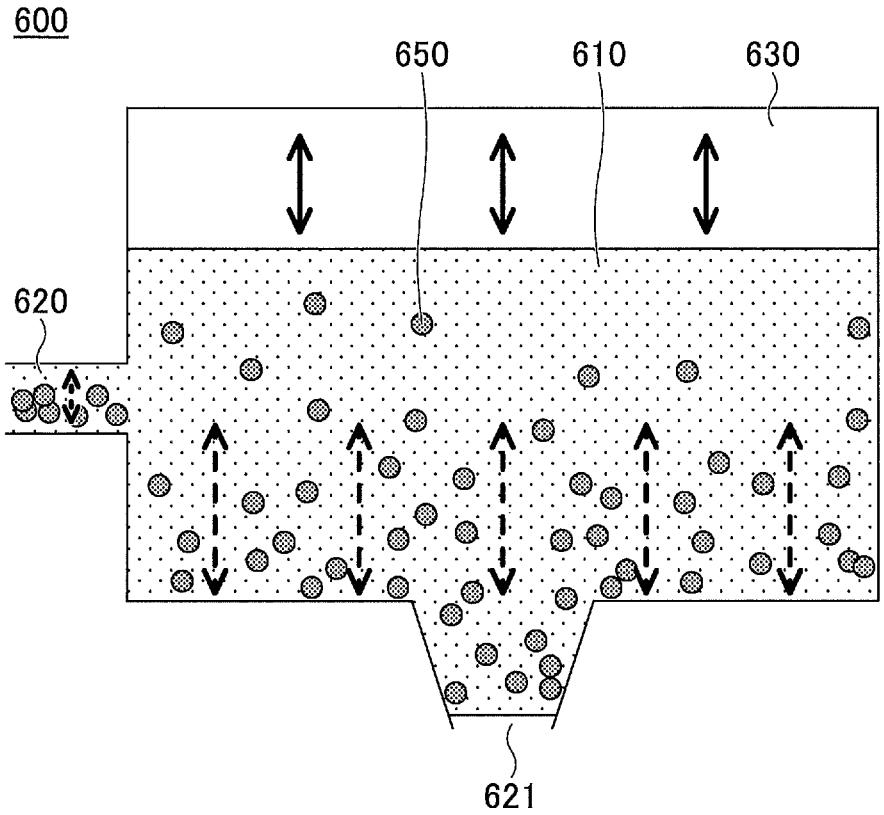
FIG. 5A is a diagram for illustrating difference between the liquid droplet forming apparatus 10 and a conventional liquid droplet forming apparatus.
Figure 5B:
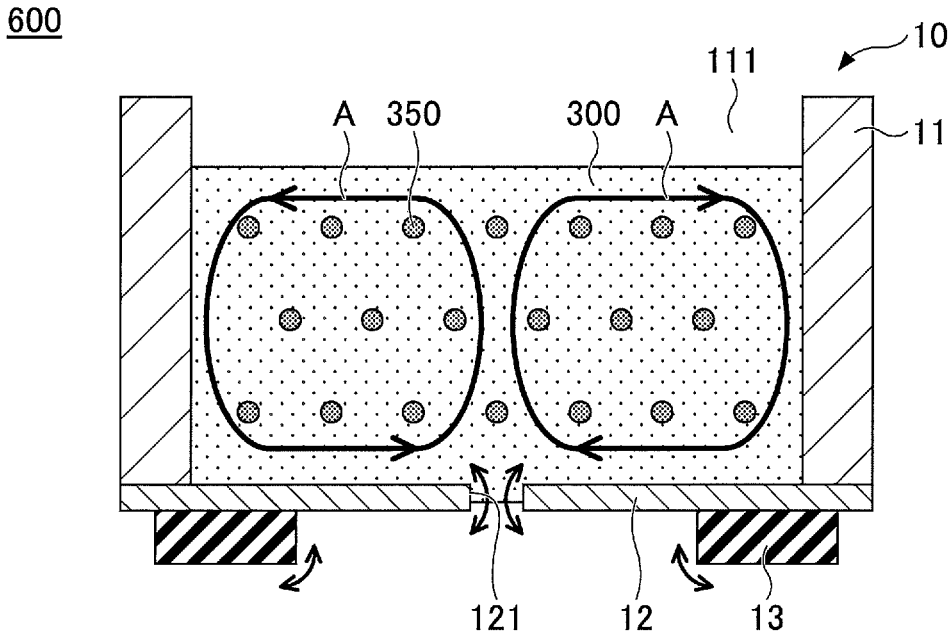
FIG. 5B is another diagram for illustrating difference between the liquid droplet forming apparatus 10 and the conventional liquid droplet forming apparatus.
Figure 6:
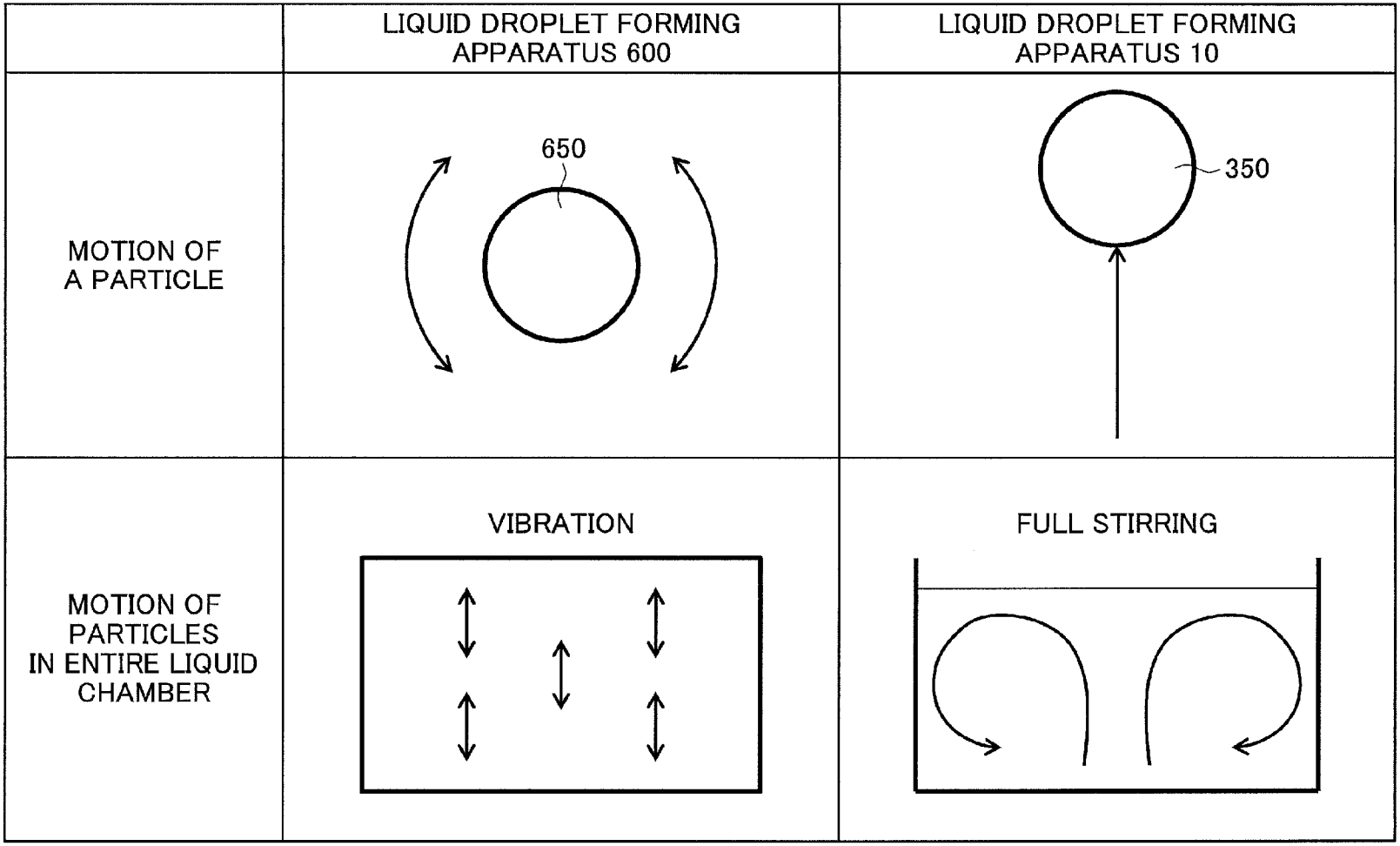
FIG. 6 is another diagram for illustrating difference between the liquid droplet forming apparatus 10 and the conventional liquid droplet forming apparatus.

FIG. 5A and FIG. 5B are diagrams for illustrating difference between the liquid droplet forming apparatus 10 and the conventional liquid droplet forming apparatus. FIG. 6 is another diagram for illustrating difference between the liquid droplet forming apparatus 10 and the conventional liquid droplet forming apparatus.

In a conventional liquid droplet forming apparatus 600 shown in FIG. 5A, a piezoelectric element 630 is disposed in an upper side or in a side surface of a liquid chamber 610. In the liquid droplet forming apparatus 600, the piezoelectric element 630 is vibrated as shown as solid arrows to give motion energy to the precipitating particles 650 through dispersing liquid held in the liquid chamber 610, thereby dispersing the precipitating particles 650 that are precipitated and congregated around the nozzle 621 or flow passage 620 as shown as dotted arrows.

In this case, as shown in FIG. 6, each precipitating particle 650 slightly vibrates. Hence, the respective precipitating particles 650 vibrate at respective positions in the entire liquid chamber 610. Therefore, although the precipitated and congregated precipitating particles 650 can be dispersed, the precipitating particles 650 cannot be stirred.

That is, when using a method in which the motion energy is given to the precipitating particles 650 through dispersing liquid as performed in the liquid droplet forming apparatus 600, the precipitating particles 650 cannot be stirred enough to be uniform in the liquid chamber and the precipitating particles 650 exist in the liquid chamber 610 with a certain distribution. Therefore, the number of the precipitating particles 650 in the ejected droplet may vary.

On the other hand, in the liquid droplet forming apparatus 10 shown in FIG. 5B, the piezoelectric element 13 is disposed at lower side of the membrane 12 in which the nozzle 121 is formed. Therefore, the membrane 12 vibrates as shown as solid arrows in accordance with the vibration of the piezoelectric element 13 as shown as solid arrows, thereby causing a liquid flow from lower side to upper side of the liquid chamber 11.

In this case, as shown in FIG. 6, each precipitating particle 350 moves from the lower side to the upper side. Hence, convective flows shown as arrows "A" occurs in entire liquid held in the liquid chamber 11 to stir the liquid 300 including the precipitating particles 350. That is, according to the liquid flow from the lower side to the upper side of the liquid chamber 11, the precipitating particles 350 are dispersed to uniformly exist in the liquid chamber 11, thereby suppressing the variance of numbers of cells in the ejected droplets.

Also, by vibrating the membrane 12 disposed at a lower side of the liquid droplet forming apparatus 10, the precipitating particles 350 can be efficiently stirred since the motion energy can be directly given to the precipitating particles 350 precipitated in the liquid chamber 11 without involving the dispersing liquid.

Additionally, frequencies for vibrating the piezoelectric element are significantly different in between the liquid droplet forming apparatus 600 and the liquid droplet forming apparatus 10. In the liquid droplet forming apparatus 600, the vibration frequency of the piezoelectric element 630 is approximate 100 kHz.

On the other hand, in the liquid droplet forming apparatus 10, the vibration frequency of the piezoelectric element 13 for stirring the liquid 300 is approximate 20 kHz. The precipitating particles 350 need to be moved slowly and largely since the precipitating particle 350 (e.g., cell) is heavier than the precipitating particle 650 (e.g., pigment) and has a diameter approximate 100 times greater than a diameter of the precipitating particle 650. Therefore, the frequency in the precipitating particle 10 is lower than the frequency of the liquid droplet forming apparatus 600.

Figure 7:
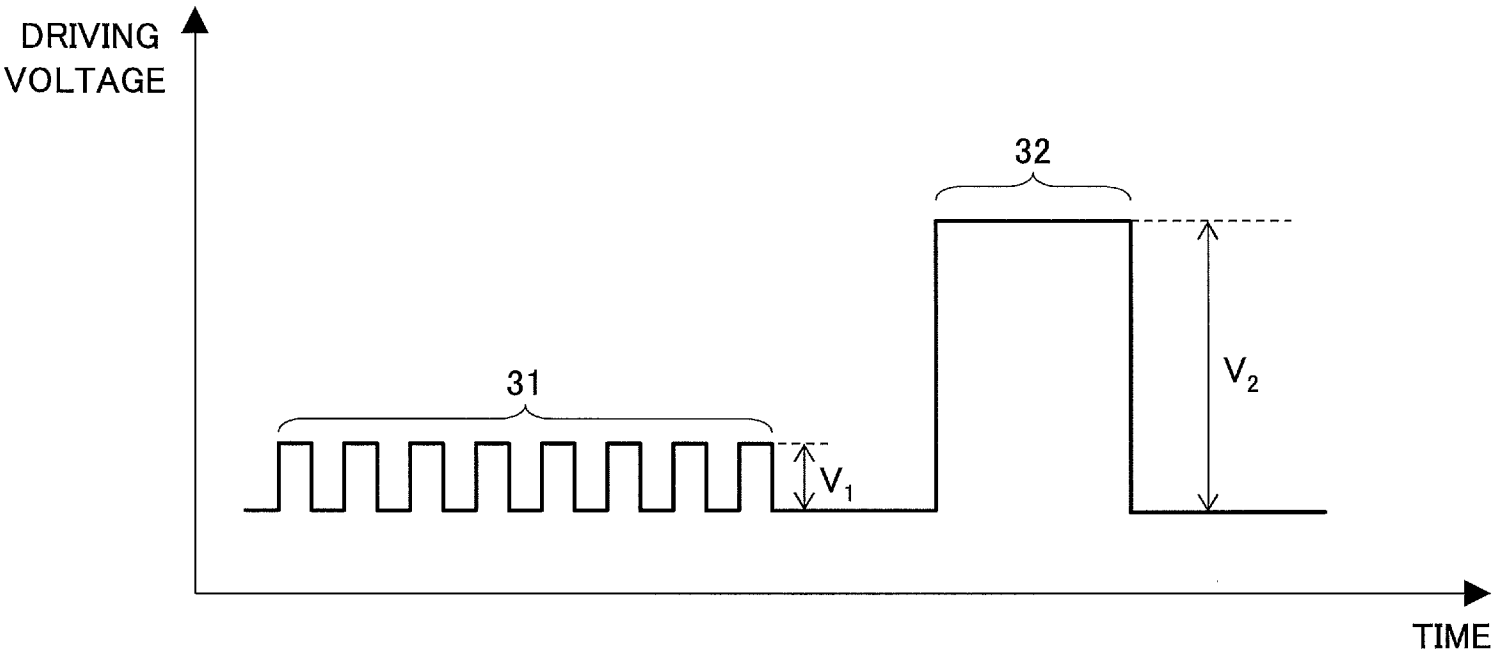
FIG. 7 is a diagram for illustrating examples of the stirring waveform and the ejection waveform generated by the driving device.

FIG. 7 is a diagram for illustrating examples of the stirring waveform and the ejection waveform generated by the driving device 30. In FIG. 7, the stirring waveform 31 and the ejection waveform 32 respectively consist of square wave, and in the example shown in FIG. 7, the ejection waveform 32 of a pulse is input after inputting the stirring waveform 31 of pulses for a certain period. A driving voltage V1 of the stirring waveform 31 is less than the driving voltage V2 of the ejection waveform 32 so that the droplet 310 is not formed in response to applying the stirring waveform 31.

As described above, the liquid droplet forming apparatus 10 of the present embodiment controls the vibration of the membrane 12 to perform stirring and ejection. Hence, the variance of the number of the precipitating particles 350 in the formed droplet 310 can be suppressed by dispersing the liquid 300 including the precipitating particles 350 without causing irregularities in the dispersion, while the clogging of the nozzle 121 can be prevented. Consequently, the liquid 300 including the precipitating particles 350 can be continuously and stably ejected for a long time as the droplets 310.

First Variation of First Embodiment

An appropriate example of the stirring waveform is shown in the first variation of the first embodiment. Descriptions on elements or the like that have substantially similar functions and configurations to those described above may be omitted in the first variation.

It is known that a disk whose edge (circumference part) is fixed has a plurality of natural vibration modes, which is described in detail, for example, in "WATARI ATSUSHI, *KIKAI SHINDO*, MARUZEN, pp 62-65" (hereinafter, referred to as NonPatent Document 1).

According to NonPatent Document 1, a natural frequency "fns" of a disk can be calculated by using a number "n" of diameter direction nodes and a number "s" of circular nodes.

Figure 8:
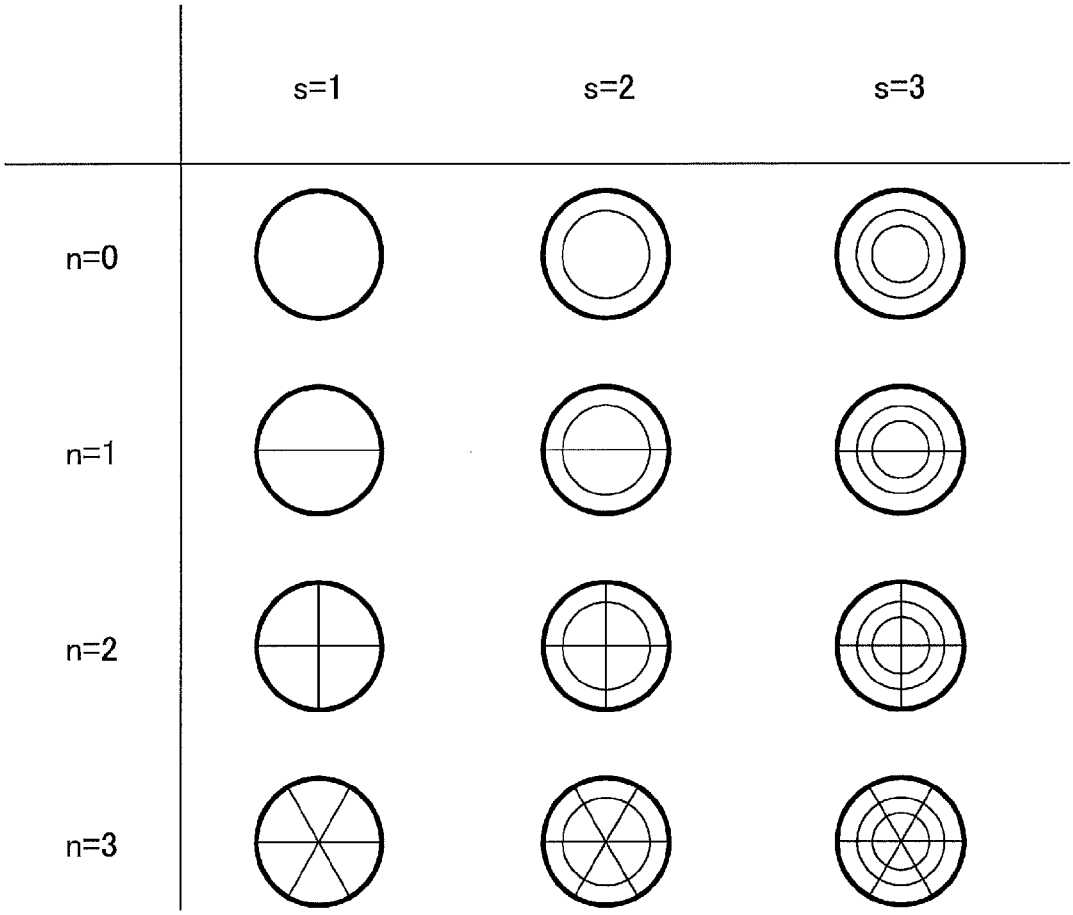
FIG. 8 is a diagram for illustrating natural vibration modes of a disk whose edge is fixed.

FIG. 8 is a diagram for illustrating the natural vibration modes of a disk whose edge is fixed. FIG. 8 schematically illustrates the natural vibration modes of the disk in a case where the value "n" of the natural frequency "fns" is "0"-"3" and the value "s" of the natural frequency "fns" is "1"-"3". In FIG. 8, outer circles indicate the disk, and lines in the outer circles indicate the nodes of vibration. Phases of vibrations of adjacent nodes are reverse to each other.

Here, the vibration of the disk in a case where "n"=0 and "s"=1 is referred to as a basic mode, and respective vibrations other than the basic mode are referred to as higher order modes. As shown in FIG. 8, the disk includes no nodes of vibration only when the disk vibrates in the basic mode. Respective natural frequencies "fns" of the higher order modes are shown in table 1, where the natural frequency "f0" of the basic mode is set to be "1". According to table 1, when the frequency is more than twice of the natural frequency of the basic mode, a secondary natural vibration mode (natural frequency f11) is excited.

TABLE 1

| | s = 1 | s = 2 | s = 3 |
|---|---|---|---|
| n = 0 | 1 | 3.91 | 8.73 |
| n = 1 | 2.09 | 5.98 | 11.9 |
| n = 2 | 3.43 | 8.69 | 15.5 |

When inputting the stirring waveform to perform stirring by vibrating the membrane 12, amount of the precipitating particles 350 may be biased in a case where the higher order mode is excited to cause a distribution of vibration intensities in the surface of the membrane 12. In this case, although uniformity of the amount of the precipitating particles 350 can be improved in comparison to a case where the stirring is not performed, the variance in the number of the precipitating particles 350 in the droplet 310 still remains.

For example, when a frequency of the rectangular wave shown in FIG. 7 is close to the natural frequency of the higher order mode, the higher order mode is excited in response to inputting the rectangular wave. Also, even if the frequency of the rectangular wave is less than the natural frequency of the higher order mode, the higher order mode may be excited due to edge of the rectangular wave since the edge of the rectangular wave is steep.

Figure 9A:
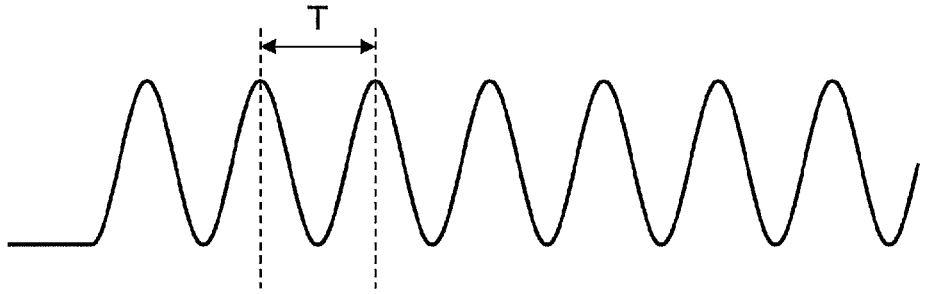
FIG. 9A is a diagram for illustrating a sine wave including only a specific frequency component.
Figure 9B:
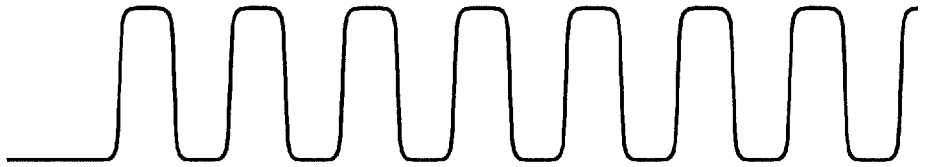
FIG. 9B is diagram for illustrating a waveform generated by performing low-pass filtering on rectangular wave.

Therefore, as shown in FIG. 9A and FIG. 9B, preferably, the stirring waveform is generated based on a signal whose frequency is less than the natural frequency of the higher order mode of the membrane 12, that is, the stirring waveform does not have the natural frequency of the higher order mode. FIG. 9A is a diagram for illustrating a sine wave including only a specific frequency component, and the frequency (=1/T) thereof is less than the natural frequency f11 of the secondary mode.

Another example of the preferable stirring waveform is shown in FIG. 9B. FIG. 9B is diagram for illustrating a waveform generated by performing low-pass filtering on the rectangular wave shown in FIG. 7 at a frequency less than the secondary natural frequency f11, where the wave form does not include the frequency component of the higher order mode. The aforementioned examples are not limiting examples, and the stirring waveform may be an arbitrary waveform in which the frequency component of the higher order mode has been cut off.

According to NonPatent Document 1, the natural frequency f01 of the basic mode is expressed by formula (1) shown below.

[Math. 1]

$$f_{01} = \frac{0.467t}{r^2}\sqrt{\frac{E}{\rho(1-\sigma^2)}} \tag{1}$$

Wherein, "t" indicates a thickness of the membrane 12, "r" indicates a radius of the membrane 12, "ρ" indicates a density of the material forming the membrane 12, and "E" and "σ" respectively indicate a Young's modulus, and a Poisson's ratio of the material forming the membrane 12.

The natural frequency of the basic mode and the natural frequency of the higher order mode with respect to the membrane 12 can be estimated in advance based on the aforementioned formula (1) and table 1. However, the values are estimated assuming that the membrane is in the atmosphere. If one side surface of the membrane is in contact with liquid as the case of the present embodiment, actual values of the natural frequencies vary.

The values of the natural frequencies vary in accordance with amount of the liquid (as described with reference to FIG. 12). However, for example, according to NonPatent Document 2, approximate values of the natural frequencies can be calculated by formula (2) shown below. Here, *Vibration of Circular Membranes in Contact with Water,* 1994 Journal of Sound and Vibration 178(5), pp. 688-690 is referred to as NonPatent Document 2.

[Math. 2]

$$f_{w01} = \frac{f_{01}}{\sqrt{1+\frac{\rho w \cdot r}{\rho \cdot t}\Gamma}} \tag{2}$$

Wherein, "fw01" indicates the natural frequency of the basic mode in a case where one side surface of the membrane is in contact with liquid, "ρw" indicates a density of the water, "Γ" indicates a constant referred to as NAVMI coefficient. It is known that "Γ" is 0.746313 at f01. For example, when using a SUS whose diameter (diameter inside fixed portion) is approximate 10 mm and thickness is approximate 50 μm as the membrane 12, "fw01" is approximate 30% of "f01".

Also, according to a similar calculation using NAVMI coefficient disclosed in NonPatent Document 2, the natural frequency of the higher order mode in the liquid is approximate 45% to 60% of the natural frequency in the atmosphere.

As described above, when the stirring waveform is generated based on a signal whose frequency is less than the natural frequency of the higher order mode in the membrane 12, a distribution of vibration intensities in the surface of the membrane 12 and unevenness in the stirring can be suppressed.

Although, hereinabove, the membrane 12 is a disk whose edge is fixed, the membrane 12 may be a rectangular plate whose edge is fixed. It is known that the rectangular plate has a plurality of natural vibration modes similarly to the disk, and the natural frequency "fjk" thereof can be calculated by using "j" and "k", where "j" indicates a number of nodes in vertical direction and "k" indicates a number of nodes in horizontal direction.

Figure 10:
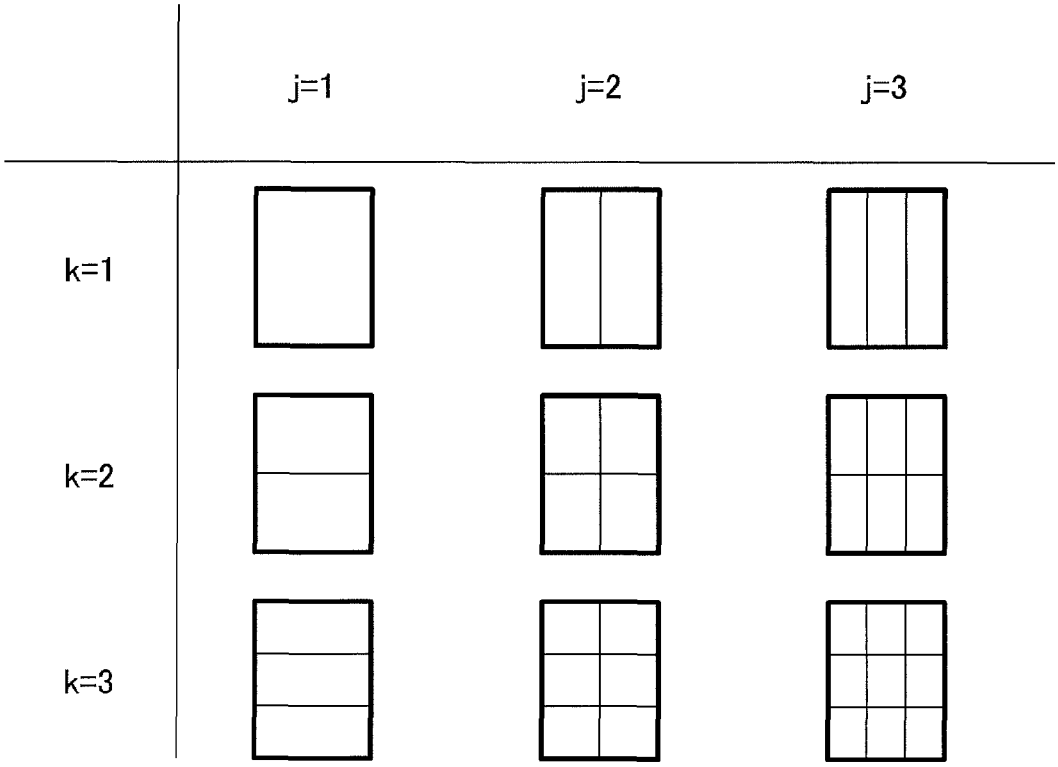
FIG. 10 is a diagram for illustrating the natural vibration modes of a rectangular plate whose edge is fixed.

FIG. 10 is a diagram for illustrating the natural vibration modes of the rectangular plate whose edge is fixed. In FIG. 10, the natural vibration modes of the rectangular plate are schematically illustrated in a case where "j" of the natural vibration mode "fjk" is "1"-"3" and "k" of the natural vibration mode "fjk" is "1"-"3". In FIG. 10, outer rectangular indicate the plate while lines inside the outer rectangular indicate nodes of vibration. Phases of vibrations of adjacent nodes are reverse to each other.

Here, the vibration of the plate in a case where "j"=1 and "k"=1 is referred to as a basic mode, and respective vibrations other than the basic mode are referred to as higher order modes. As shown in FIG. 10, the plate includes no nodes of vibration only when the plate vibrates in the basic mode.

According to NonPatent Document 1, the natural frequency f11 of the basic mode is expressed by formula (3).

[Math. 3]

$$f_{11} = 0.453t\left(\frac{1}{l^2}+\frac{1}{m^2}\right)\sqrt{\frac{E}{\rho(1-\sigma^2)}} \tag{3}$$

Wherein, "l", "m" and "t" respectively indicate a length, a width and a thickness of the membrane 12, "ρ" indicates a density of the material forming the membrane 12, and "E" and "σ" respectively indicate a Young's modulus, and a Poisson's ratio of the material forming the membrane 12.

The natural frequency of the basic mode and the natural frequency of the higher order mode with respect to the membrane 12 can be estimated in advance based on the aforementioned formula (3) and FIG. 10.

Also, the membrane 12 may be a slit plate, where both edges of the slit plate are fixed. It is known that the slit plate fixed at both edges thereof has a plurality of natural vibration modes. When one of a length and a width of the slit plate is much longer than the other, the vibration of the slit plate can be regarded as not a vibration in two dimensional direction, but a vibration in one dimensional direction. The natural frequency "fi" of the slit plate can be calculated by using a number "i" of loops of vibration.

Figure 11:
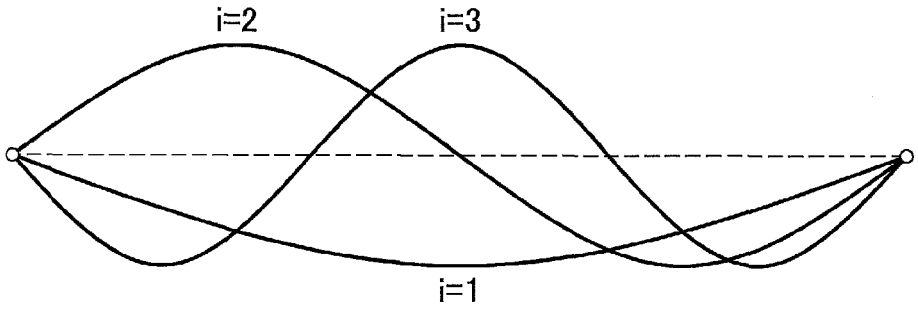
FIG. 11 is a diagram for illustrating the natural vibration modes of a slit plate fixed at both edges thereof.

FIG. 11 is a diagram for illustrating the natural vibration modes of the slit plate fixed at both edges thereof. FIG. 11 schematically illustrates vibrations of the slit plate, where "i" of the natural frequency "fi" is "1"-"3". Here, the vibration of the slit plate at "i"=1 is referred to as a basic mode, and respective vibrations other than the basic mode are referred to as higher order modes. As shown in FIG. 11, the slit plate does not include any nodes of vibration except the fixed both edges only when the slit plate vibrates in the basic mode.

According to NonPatent Document 1, the natural frequency f1 of the basic mode is expressed by formula (4).

[Math. 4]

$$f_1 = \frac{3.56}{l^2}\sqrt{\frac{EJ}{\rho A}} \tag{4}$$

Wherein, "l" indicates a length of the membrane 12, "A" and "J" respectively indicate cross sectional area of the membrane 12 and cross sectional secondary moment of the cross section, "ρ" indicates a density of the material forming the membrane 12, and "E" indicates a Young's modulus of the material forming the membrane 12.

The natural frequency of the basic mode and the natural frequency of the higher order mode with respect to the membrane 12 can be estimated in advance based on the aforementioned formula (4) and FIG. 11.

As described above, similarly to the case of the disk, when the stirring waveform is generated based on a signal whose frequency is less than the natural frequency of the higher order mode in the membrane 12, a distribution of vibration intensities in the surface of the membrane 12 and unevenness in the stirring can be suppressed in a case where the membrane 12 is a rectangular plate whose edge is fixed or a slit plate fixed at both edges thereof.

Second Variation of First Embodiment

Other appropriate examples of the stirring waveform are shown in the second variation of the first embodiment. Descriptions on elements or the like that have substantially similar functions and configurations to those described above may be omitted in the second variation.

The frequency (=1/T) of the stirring waveforms shown in FIG. 9A and FIG. 9B may be coincident with the natural frequency of the basic mode of the membrane 12. In this case, the stirring can be most efficiently performed since the membrane 12 can be vibrated with significantly low driving voltage and the precipitating particles 350 exist in the stirred liquid without irregularities in the dispersion.

However, the natural frequency of the membrane 12 varies depending on the amount of the liquid 300 held in the liquid chamber 11. FIG. 12 is a graph for illustrating an example measuring result of the natural frequency of the basic mode in a prototype liquid droplet forming apparatus by using a laser Doppler vibration meter (LV-1710, manufactured by "ONO SOKKI" corporation). Additionally, in the prototype liquid droplet forming apparatus, a ring-shaped push-type piezoelectric element (material C-2, manufactured by "FUJI CERAMIC" corporation) is used as the piezoelectric element 13 and a nozzle-type SUS pinhole whose diameter is 35 μm (manufactured by Edmund optics corporation) is used as the membrane 12.

Figure 12:
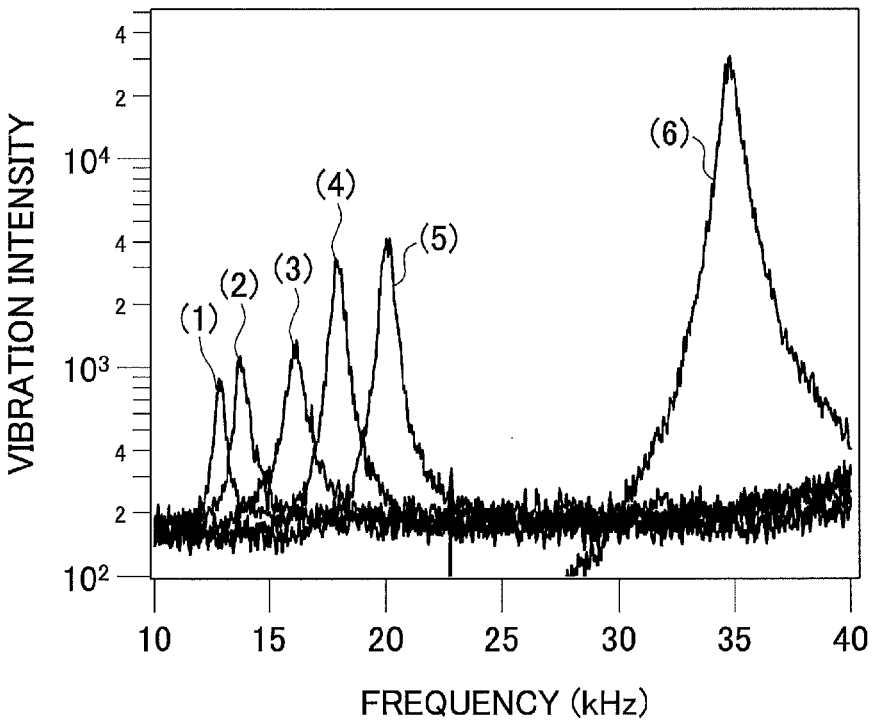
FIG. 12 is a graph for illustrating an example measuring result of the natural frequency of the basic mode in a prototype liquid droplet forming apparatus.

In FIG. 12, line (1) corresponds to the liquid amount 50 μl, line (2) corresponds to the liquid amount 40 μl, line (3) corresponds to the liquid amount 30 μl, line (4) corresponds to the liquid amount 20 μl, line (5) corresponds to the liquid amount 10 μl, and line (6) corresponds to the liquid amount 0 μl (no liquid), where the respective lines indicates relationships between the vibration intensity and the frequency at respective amounts of liquid held in the liquid chamber.

As shown in FIG. 12, the natural frequency of the basic mode at the liquid amount 50 μl (shown as line (1) in FIG. 12) is less than the natural frequency of the basic mode at the liquid amount 10 μl (shown as line (5) in FIG. 12) by approximate 40%. It is difficult to keep the frequency of the stirring waveform to be coincident with the natural frequency of the basic mode since the liquid amount reduces as the droplets are formed, or reduces due to aridity.

Therefore, a range of variance of the natural frequency of the basic mode that varies depending on the liquid amount is preferably included in a range between a first frequency and a second frequency that is different from the first frequency, where the frequency of stirring waveform varies in the range between the first frequency and the second frequency. Thus, even if the natural frequency of the basic mode varies depending on the liquid amount, the membrane 12 can be efficiently vibrate at the natural frequency of the basic mode since the natural frequency of the basic mode only varies in a range from the first frequency to the second frequency.

Figure 13:
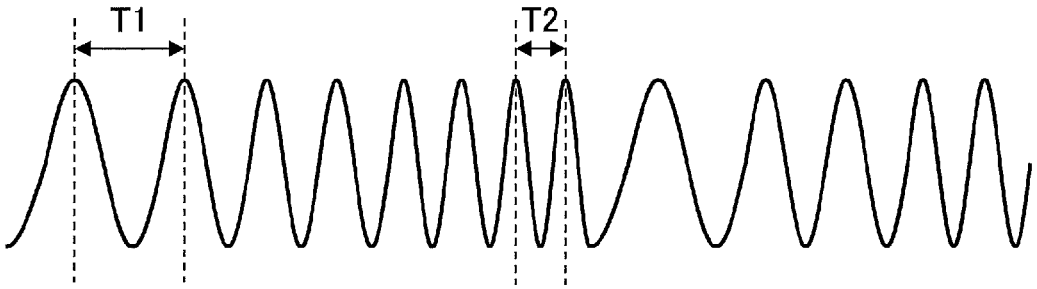
FIG. 13 is a diagram for schematically illustrating an example stirring waveform whose frequency varies in a range from a first frequency to a second frequency.

FIG. 13 is a diagram for schematically illustrating an example stirring waveform whose frequency varies in a range from the first frequency to the second frequency. Wavelength in the stirring waveform continuously varies from a wavelength corresponding to the first frequency f1 (=1/T1) to a wavelength corresponding to the second frequency f2 (=1/T2), where more wave lengths than the wave lengths shown in FIG. 13 are included in the actual stirring waveform.

Additionally, in FIG. 13, although the stirring waveform is shown as a continuously modulated sine wave signal, this is not a limiting example. A rectangular wave signal or triangular wave signal on which the low-pass filtering is performed may be used. And the signal does not have to be continuously modulated, but may be modulated by switching the frequency of the modulation step by step. Also, a similar effect of the stirring can be expected by using a type of beat signal in which a plurality of frequency components are mixed instead of using a waveform in which the frequency is swept.

As described above, preferably, the stirring waveform includes the natural frequency of the basic mode of the membrane 12, which enables to perform efficient stirring with small energy.

Also, more preferably, the frequency of the stirring waveform varies from the first frequency to the second frequency, where the natural frequency of the basic mode of the membrane 12 is within a range between the first frequency to the second frequency. In this case, the stirring can be stably performed even when the natural frequency of the membrane 12 varies depending on the liquid amount in the liquid chamber 11.

Figure 14:
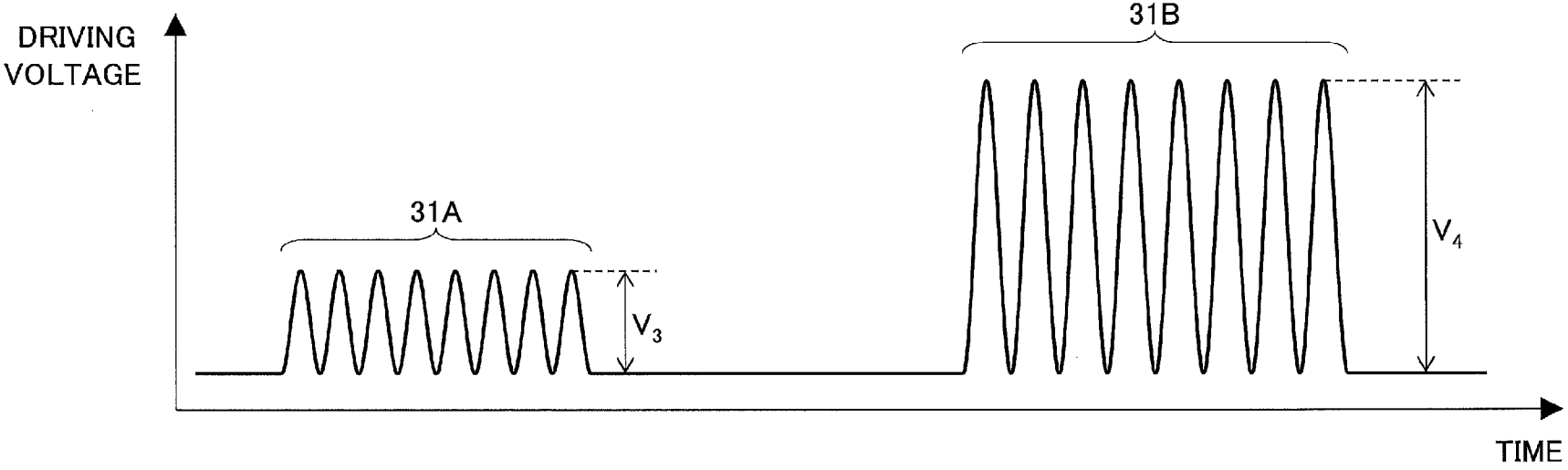
FIG. 14 is a diagram for illustrating an example stirring waveforms with discrete driving voltages.

As shown in FIG. 14, in order to uniformly stir the liquid in the liquid chamber, a second stirring waveform 31B, other than a first stirring waveform 31A for vibrating the membrane 12 without forming the droplet, may be used, where a voltage of the second stirring waveform 31B is greater than the voltage of the first stirring waveform 31A. In FIG. 14, since the driving voltage V4 of the second stirring waveform 31B is greater than the driving voltage V3 of the first stirring waveform 31A, the membrane 12 vibrates more strongly to stir the liquid in the liquid chamber 11 more uniformly.

Figure 15A:
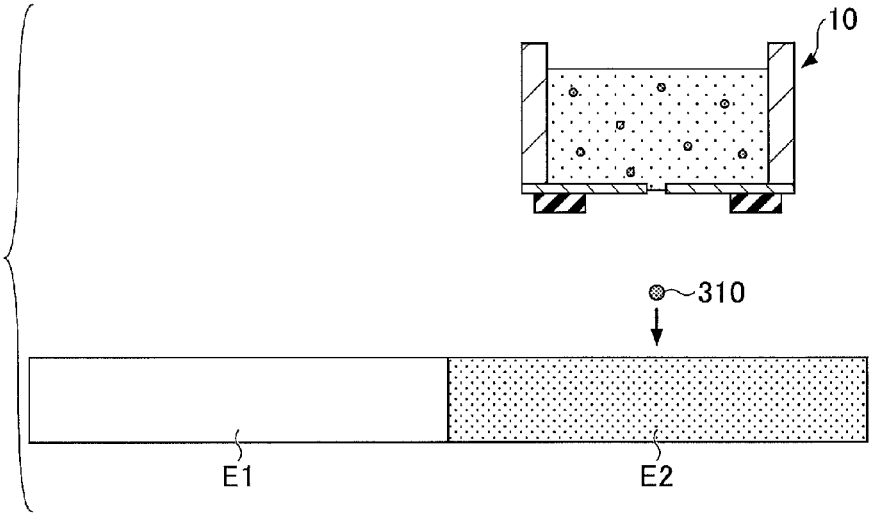
FIG. 15A is a diagram for illustrating drawing regions in a case where the stirring is performed by using the stirring waveforms shown in FIG. 14.
Figure 15B:
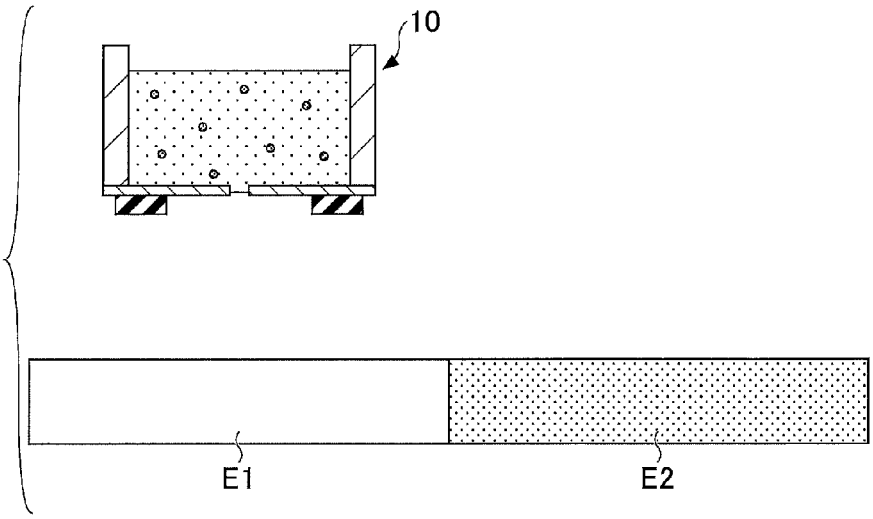
FIG. 15B is another diagram for illustrating drawing regions in a case where the stirring is performed by using the stirring waveforms shown in FIG. 14.

In this case, unexpected droplets may be formed due to the strong vibration of the membrane 12. Therefore, as shown in FIG. 15A, in a case where the second stirring waveform 31B is used for stirring, preferably, the stirring is performed after moving the liquid droplet forming apparatus 10 to a non-drawing region E2 so as to prevent the unexpected droplet dropping on the drawing region E1. The unexpected droplet 310 may drop on the non-drawing region E2 without causing any trouble. Additionally, as shown in FIG. 15B, in a case where the first stirring waveform 31A is used for the stirring, the stirring may be performed when the liquid droplet forming-apparatus 10 is located in the drawing region E1.

A method, in which a member whose natural frequency is greater than the natural frequency of the membrane 12 is used for the stirring, is also preferable. By using the member whose natural frequency is greater than the natural frequency of the membrane 12, a problematic tendency that the precipitating particles 350 are likely to accumulate at edge portion of the bottom of the liquid chamber 11 is improved, which enables to uniformly stir the liquid in the liquid chamber 11.

Figure 16:
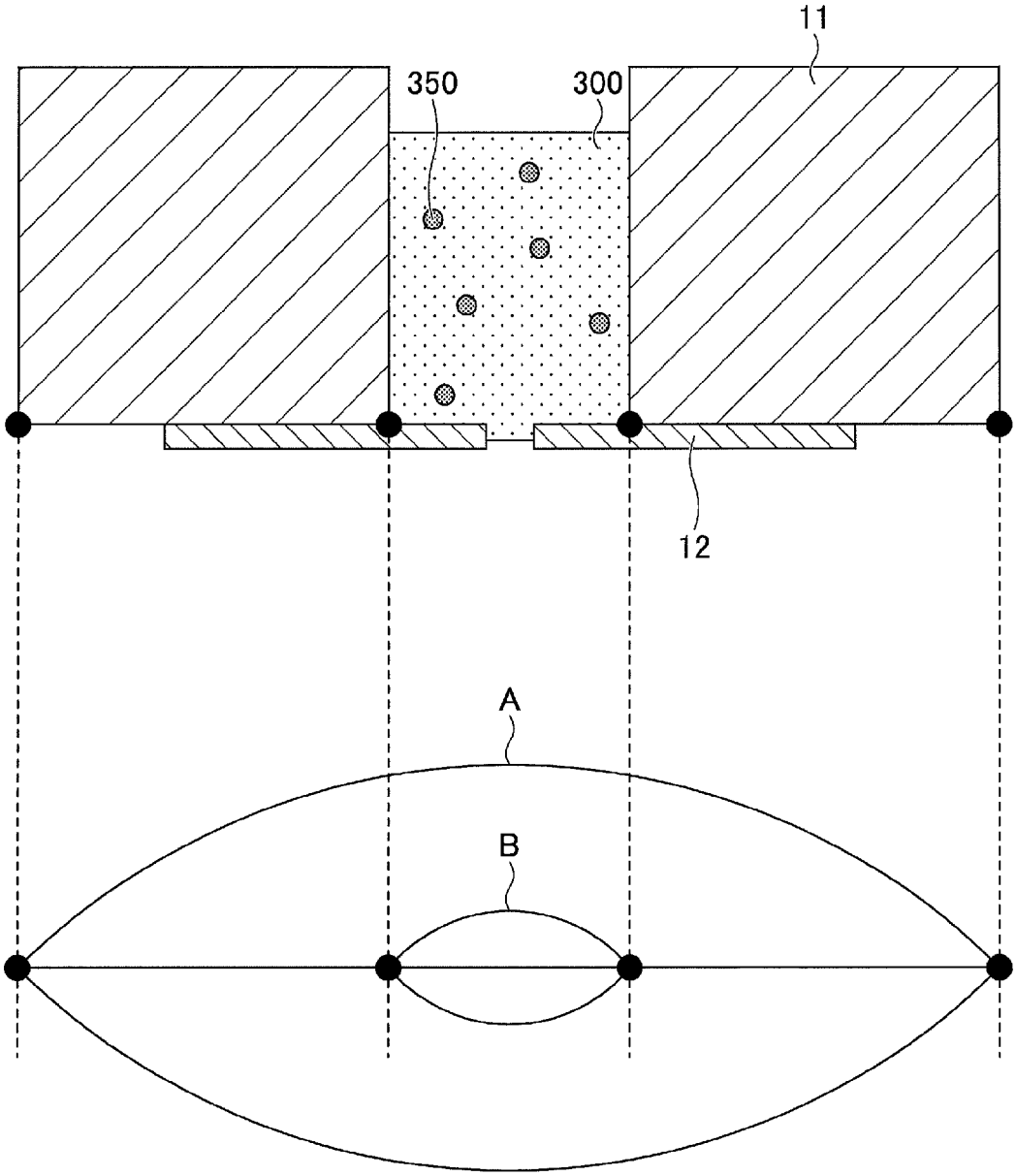
FIG. 16 is a diagram for illustrating a method for vibrating a member greater than a membrane.

For example, as shown in FIG. 16, wall of the liquid chamber 11 may be made thick to become greater than the membrane 12, and the wall may be vibrated. In this case, since the wall forming a part of the liquid chamber 11 vibrates as shown as "A" in FIG. 16, the edge portion of the membrane 12 vibrates as much as the center portion, which is exposed in the liquid chamber 11, to improve the problematic tendency that the precipitating particles 350 are likely to accumulate at edge portion of the bottom of the liquid chamber 11. Additionally, "B" shown in FIG. 16 schematically indicates a vibration when only membrane 12 is vibrated and the wall of the liquid chamber 11 is not vibrated for purpose of comparison.

Third Variation of First Embodiment

In the third variation of the first embodiment, an example liquid droplet forming apparatus including a liquid amount detection unit will be described. Descriptions on elements or the like that have substantially similar functions and configurations to those described above may be omitted in the third variation.

Figure 17A:
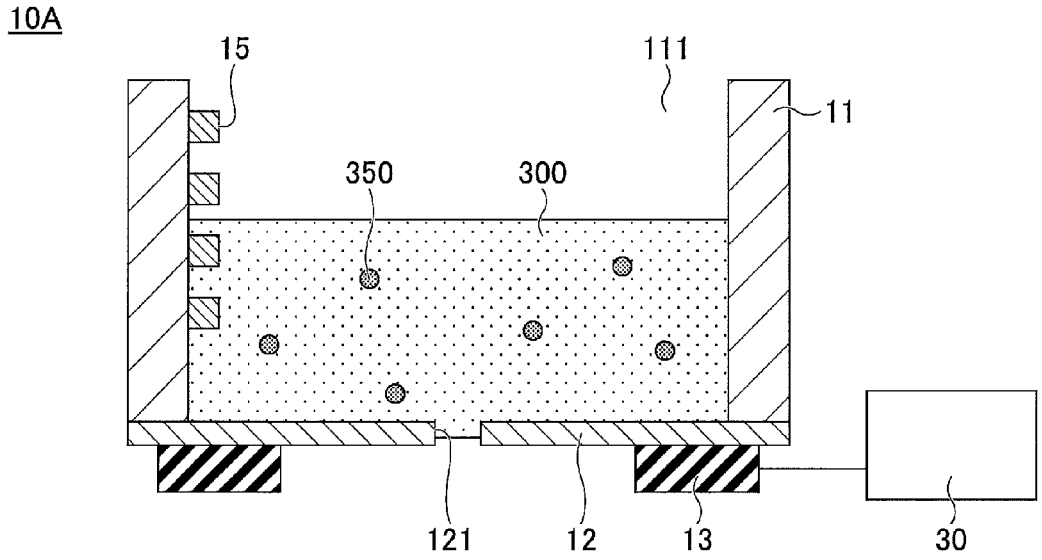
FIG. 17A is a diagram for illustrating a cross sectional view of the liquid droplet forming apparatus of a third variation of the first embodiment.
Figure 17B:
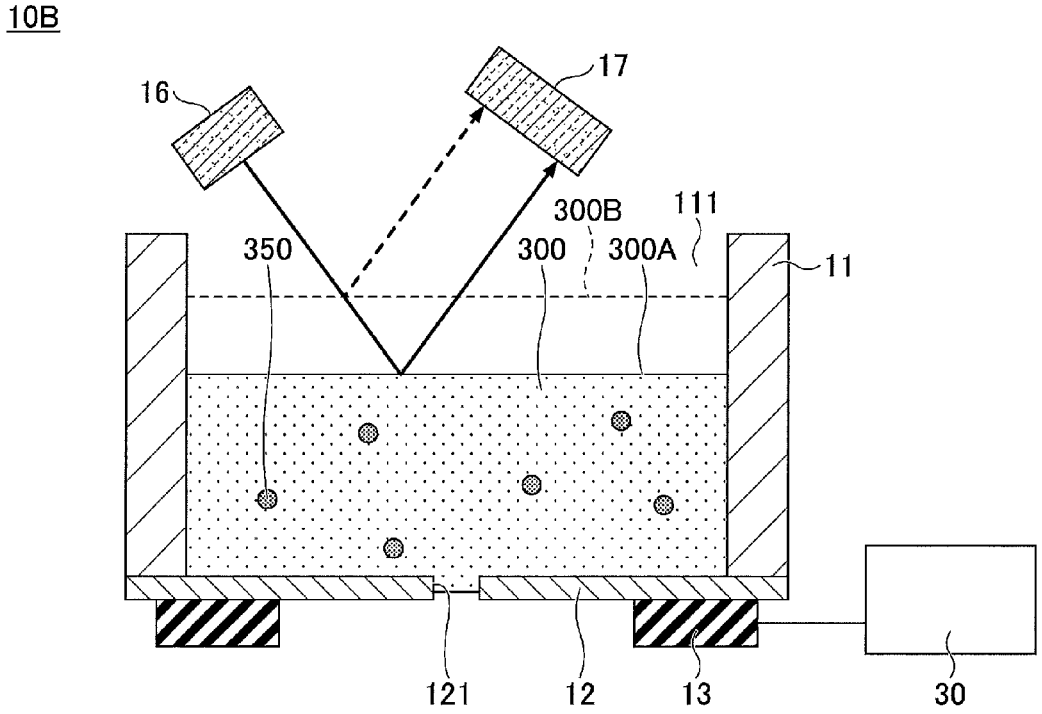
FIG. 17B is another diagram for illustrating a cross sectional view of the liquid droplet forming apparatus of a third variation of the first embodiment.

FIG. 17A and FIG. 17B are cross sectional views for illustrating examples of the liquid droplet forming apparatus of the third variation of the first embodiment including the liquid amount detection unit. In the liquid droplet forming apparatus 10A shown in FIG. 17A, a plurality of electrodes 15 as the liquid amount detection unit are disposed at inside wall surface of the liquid chamber 11, where the electrodes 15 are arranged in a depth direction of the liquid chamber 11. When using a conductive liquid as the liquid 300, the amount of the liquid 300 can be detected by finding conduction or resistance value between the electrodes 15.

In the liquid droplet forming apparatus 10B shown in FIG. 17B, a light-emitting element 16 and a position sensor 17 are located at the upper side of the liquid chamber 11, where the light-emitting element 16 and the position sensor 17 serve as the liquid amount detection unit. The position sensor 17 is located at a position where the position sensor can receive a light emitted from the light-emitting element 16 and regularly reflected at a surface 300A or a surface 300B of the liquid 300. Thus, a distance between a position at which the position sensor 17 receives the light and the surface of the liquid 300 can be calculated based on the principal of triangulation. However, the configuration of the liquid amount detection unit is not limited to the configurations shown in FIGS. 17A and 17B. Various known method for measurement of distance or detection of liquid surface may be used for achieving the liquid amount detection unit.

The driving device 30 may be configured so as to vary the stirring waveform based on an output signal of the liquid amount detection unit. For example, the driving device 30 selects an appropriate frequency based on the output signal of the liquid amount detection unit regarding the liquid amount with reference to a lookup table, thereby outputting the stirring waveforms as shown in FIG. 9A and FIG. 9B.

Also, the detection result of the liquid amount detection unit may be used for generating the stirring waveform shown in FIG. 13 in which the frequency is swept. In this case, the first frequency and the second frequency are determined based on the detection result of the liquid amount detection unit.

As described above, the liquid droplet forming apparatus 10A and 10B of the third variation of the first embodiment respectively include the liquid amount detection unit for detecting the amount of the liquid 300, and the driving device 30 of the third variation of the first embodiment controls the stirring waveform based on the detection result of the liquid amount detection unit. Thus, the stirring can be stably performed even when the natural frequency of the membrane 12 varies depending on the liquid amount since the stirring waveform adapted to the variance of the natural frequency can be output.

Fourth Variation of First Embodiment

In the fourth variation of the first embodiment, an example liquid droplet forming apparatus for providing the stirring waveform with a certain time interval will be described. Descriptions on elements or the like that have substantially similar functions and configurations to those described above may be omitted in the fourth variation.

Figure 18:
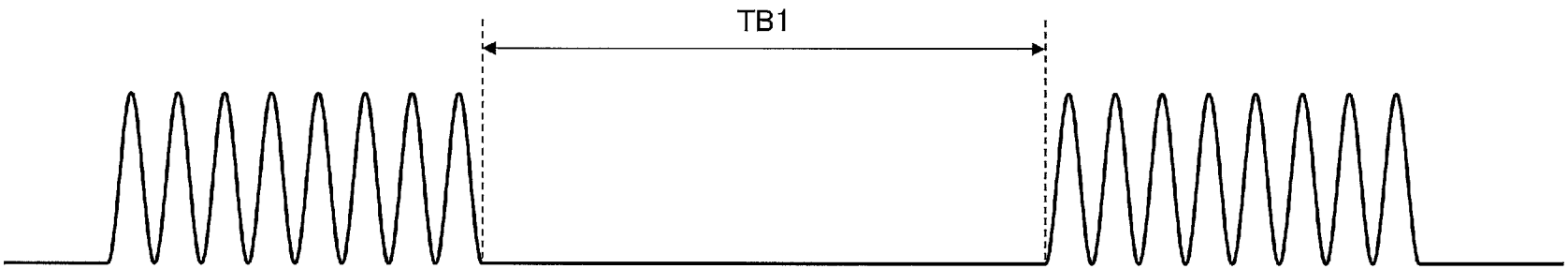
FIG. 18 is a diagram for illustrating an example of appropriate stirring waveform generated by a driving device.

Preferably, the driving device 30 does not continue to input the stirring waveform during a period in which the droplet is not formed, but periodically inputs the stirring waveform with a certain time interval TB1 as shown in FIG. 18. If the stirring waveform is continued to be input, power consumption increases and the membrane 12 is heated due to the continuous vibration, which may cause an adverse effect depending on a type of the liquid 300 including the precipitating particle 350. In particular, in a case where the liquid 300 includes cells, the heating shall be avoided since high temperature causes damage to the cells. Therefore, unnecessary stirring shall be avoided.

Further, the time interval TB1 in the stirring is preferably set in accordance with a property of the precipitating particle 350 or a property of a solvent for dispersing the precipitating particles 350. It is known that a precipitating speed of a particle can be expressed by Stokes formula shown as formula (5).

[Math. 5]

$$v = \frac{2r^2 g}{9\eta}(\rho - \delta) \quad (5)$$

Wherein, "v" indicates the precipitating speed of a particle, "g" indicates gravity acceleration, "r" indicates a radius of the particle, "η" indicates a viscosity of the solvent, "ρ" indicates a density of the particle, and "δ" indicates a density of the solvent. For example, when fine particles of polystyrene whose radius is 5 μm and whose density is 1050 kg/m$^3$ disperse in the water, the precipitating speed "v" is approximate 3 μm/s. Depending on the density of the particle, generally a thickness of the membrane 12 is 10-100 μm, and adverse effects such as a nozzle clogging start to be caused when the particles totally precipitate by approximate several μm.

Therefore, preferably, the time interval TB1, with which the stirring is performed, is approximate equal to or less than "1" sec. When the precipitating speed "v" is approximately 3 μm/s and the time interval TB1 is approximate equal to or less than "1" sec, the particles totally precipitate by approximate equal to or less than 3 μm during the stirring is not performed. Hence, the nozzle clogging, etc., can be suppressed.

For example, the user may directly set the time interval TB1 in the liquid droplet forming apparatus. Or, the liquid droplet forming apparatus may have a function for internally performing the aforementioned calculation to automatically calculate the appropriate time interval TB1 with which the stirring is performed in response to the user inputting basic data (e.g., data for indicating a type of the solvent, the density and the viscosity thereof).

As described above, in the liquid droplet forming apparatus of the fourth variation of the first embodiment, the driving device 30 periodically gives the membrane 12 the stirring waveform with a certain time interval. Thus, the stirring for preventing the precipitating particles 350 from precipitating can be performed with small energy during a period in which the droplet is not formed. Preferably, the certain time interval is set based on a property of the precipitating particle 350, and the like.

<Prototyping>

Figure 19:
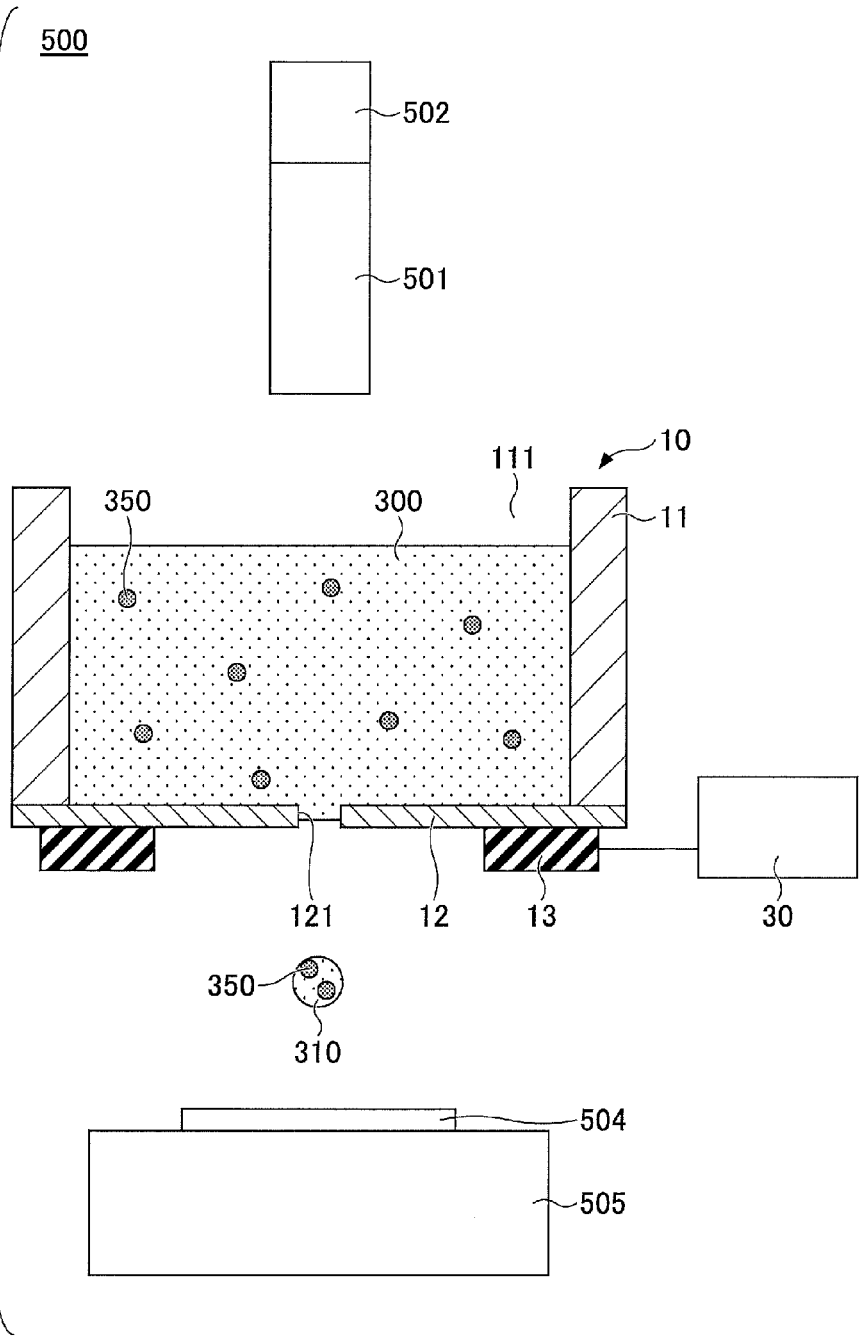
FIG. 19 is a diagram for illustrating an observation apparatus.

In the following, a test result of a prototype of the liquid droplet forming apparatus 10 will be described, by which the liquid 300 including the precipitating particles 350 is ejected. In the prototype of the liquid droplet forming apparatus 10, a bending ring piezo element (CMBR03 manufactured by Noriac Corporation) is used as the piezoelectric element 13, and a SUS pinhole whose nozzle diameter is 50 μm (#39-879, manufactured by Edmund optics Corporation) is used as the membrane 12. The test has been performed in order to validate the effect of the stirring of the precipitating particles 350 through the vibration of the membrane 12, where the effect of the stirring of the prototype of the liquid droplet forming apparatus 10 has been validated by using an observation apparatus 500 shown in FIG. 19.

The observation apparatus 500 observes inside the liquid camber 11 of the liquid droplet forming apparatus 10 by a CCD 502 with a lens 501 disposed over the liquid droplet forming apparatus 10. Also, an arbitrary pattern-shaped droplet 310 is ejected, where the droplet 310 including the precipitating particles 350 is ejected on a preparation 504 disposed on an automatic driven stage 505.

The stirring and the ejection are performed by inputting the stirring waveform and the ejection waveform from the driving device 30 to the piezoelectric element 13. At this time, a dispersion state of the liquid 300 including the precipitating particles 350 filled in the liquid chamber 11 is observed through the CCD 502. Also, a number of the precipitating particles 350 included in each droplet 310 is calculated by ejecting the droplets 310 linearly arranged on the preparation 504. Approximate 30 μl of liquid solution (Thermo Scientific, Duke 2010A) including particles of polystyrene whose diameters are approximate 10 μm is filled in the liquid chamber 11 as the liquid 300 including the precipitating particles 350.

Table 2 indicates an observation result of a stirring state of the precipitating particles 350 in the liquid chamber 11, where the stirring has been performed by using three different stirring waveforms that are a sweep waveform including the natural frequency of the basic mode, a sweep waveform including the natural frequency of the higher order mode, and no waveform (not inputting any signals). Here, the sweep waveform including the natural frequency of the basic mode means a waveform in which a range of frequency approximate 18 kHz-21 kHz is swept in approximate 0.01 sec. Also, the sweep waveform including the natural frequency of the higher order mode means a waveform in which a range of frequency approximate 69 kHz-71 kHz is swept in approximate 0.01 sec.

TABLE 2

| | SWEEP WAVEFORM (INCLUDING NATURAL FREQUENCY OF BASIC MODE) | SWEEP WAVEFORM (INCLUDING NATURAL FREQUENCY OF HIGHER ORDER MODE) | NO WAVE-FORM |
|---|---|---|---|
| VOLTAGE [V] | 3 | 3 | — |
| FREQUENCY [kHz] | 18~21 | 69~71 | — |
| STIRRING STATE | ○ | x | x |

Figure 20A:
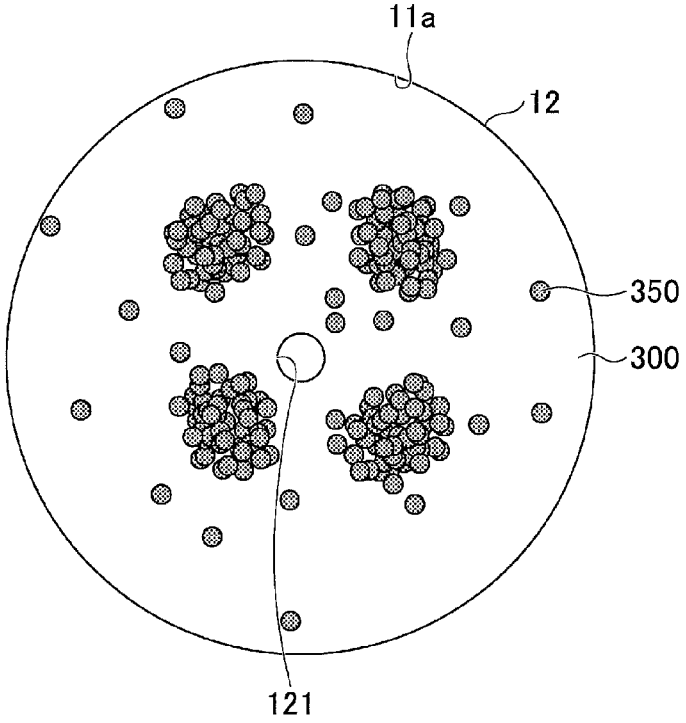
FIG. 20A is a diagram for illustrating biased dispersion of the particles.

According to table 2, when using the sweep waveform including the natural frequency of the basic mode, a stirring state of a totally uniform stirring has been observed. However, when inputting no signals, the particles have precipitated. And when using the sweep waveform including the natural frequency of the higher order mode, a distribution of vibration intensity in the surface of the membrane 12 occurs and a biased dispersion of the particles, which is schematically shown in FIG. 20A, has been observed. Additionally, in FIG. 20A, a reference "11*a*" indicates the inside wall of the liquid chamber 11.

The range of frequency in the basic mode is approximate 18 kHz-21 kHz, and the range of frequency in the higher order mode is approximate 69 kHz-71 KHz. Therefore, the frequency of the higher order mode is approximate 3.5 times higher than the frequency of the basic mode. This corresponds to the natural frequency f21 shown in table 1, where a magnification ratio between the natural frequencies of the basic mode and the frequency f21 is "3.43".

Figure 20B:
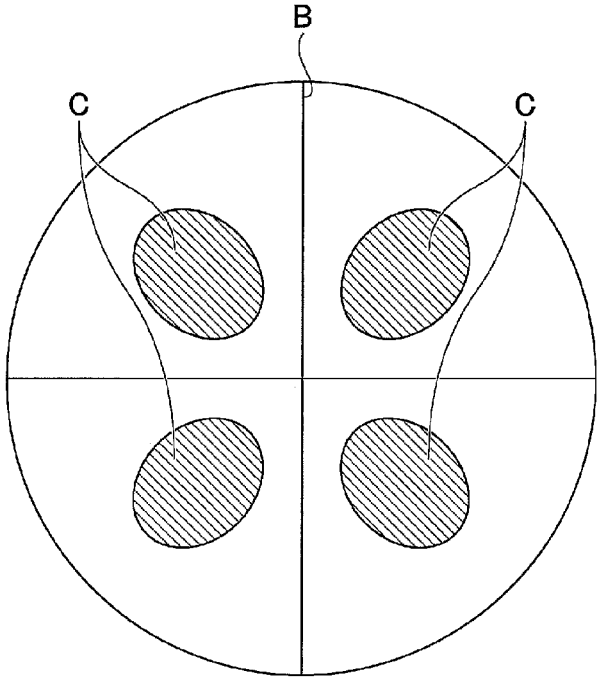
FIG. 20B is another diagram for illustrating biased dispersion of the particles.

According to Bernoulli's theorem, the particles tend to be drawn to the loops of vibration since the pressure reduces in an area where a flow speed becomes low in comparison to adjacent area, whereas the flow speed is high in the loops of vibration, that is, the intensity of vibration is greater in the loops of vibration. The biased dispersion of the particles shown in FIG. 20A is observed since the particles are drawn from positions shown as nodes in FIG. 8 to areas "C" divided with the nodes B shown in FIG. 20B at the natural frequency f21. Thus, when using the stirring waveform whose frequency corresponds to the natural frequency of the higher order mode, non-uniform dispersion state has been observed.

Figure 21:
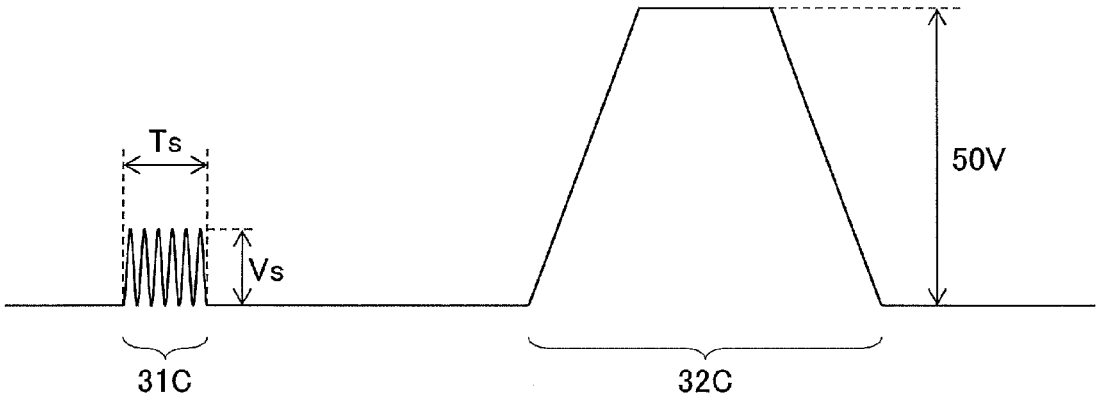
FIG. 21 is a diagram for illustrating a stirring waveform and an ejection waveform.

Then, as shown in FIG. 21, the stirring waveform 31C and the ejection waveform 32C have been alternately input to eject the droplet 310 including the precipitating particles 350 onto the preparation 504. The numbers of the precipitating particles 350 included in the ejected droplets 310 have calculated in order to validate a suppressing effect of the variance of the number of the precipitating particles 350 in the droplet 310.

In this case, the ejection has been performed at 2 kHz, and a simple trapezoid wave whose voltage is 50 V is used as the ejection waveform 32C. Also, a sweep waveform including the natural frequency of the basic mode whose voltage Vs is 1.4 V and a stirring time (period) Ts is 0.3 sec. is used as the stirring waveform 31C. The ejection has been started just after filling the liquid 300 including the precipitating particles 350 in the liquid chamber 11.

Table 3 shows standard deviations of calculation results of the numbers of precipitating particles 350 in the droplet 310, where the numbers of the precipitating particles have been calculated at respective timings of 0, 1, and 2 minutes passes from the ejection (the calculation has been performed 30 times at respective timings, 90 times in total: which is referred to as a first half) and the numbers of the precipitating particles have been calculated at respective timings of 4 and 8 minutes passes from the ejection (the calculation has been performed 30 times at respective timings, 60 times in total: which is referred to as a second half).

TABLE 3

| | SWEEP WAVEFORM (INCLUDING NATURAL FREQUENCY OF BASIC MODE) | | NO WAVE-FORM | |
|---|---|---|---|---|
| VOLTAGE Vs [V] | 1.4 | | 0 | |
| STIRRING TIME Ts [s] | 0.3 | | 0 | |
| TIME PASSES FROM EJECTION [min] | 0, 1, 2 | 4, 8 | 0, 2 | 4, 8 |
| STANDARD DEVIATION [NUMBER OF PARTICLES] | 2.2 | 2.1 | 2.8 | 3.9 |

According to table 3, when using the stirring waveform 31C that is the sweep waveform including the natural frequency of the basic mode to stir the liquid 300, there is not a significant difference between values of the standard deviations' in the first half and the second half. However, when inputting no signals, the standard deviation in the second half increases in comparison to the first half. The reason is considered that the non-uniform dispersion state of the precipitating particle 350 is caused due to precipitation of the precipitating particles 350 as the time passes in a case where the stirring is not performed, while the variance of the numbers of the precipitating particles 350 in the droplet 310 is unlikely to be observed just after the ejection since the dispersion state of the precipitating particles 350 is kept uniform.

As described above, in a case where the stirring has been performed, it has been observed that the standard deviation of the numbers of the precipitating particles 350 in the droplets 310 has not significantly varied even after the time passes. That is, suppression effect of the variance of the numbers of the precipitating particles 350 in the ejected droplets 310 due to the stirring using the vibration of the membrane 12 has been observed.

Herein above, although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth. The present application is based on Japanese Priority Application No. 2014-259121 filed on Dec. 22, 2014, Japanese Priority Application No. 2015-109677 filed on May 29, 2015, and Japanese Priority Application No. 2015-200822 filed on Oct. 9, 2015, the entire contents of which are hereby incorporated herein by reference.

What is claimed is:

1. A liquid droplet forming apparatus comprising:

a liquid holding part configured to hold a liquid including precipitating particles;

a film member configured to be vibrated so as to eject the liquid held in the liquid holding part, wherein a nozzle is formed in the film member and the liquid is ejected as a droplet from the nozzle;

a vibrating unit configured to vibrate the film member; and a driving unit configured to selectively apply an ejection waveform and a stirring waveform to the vibrating unit, wherein the film member is vibrated to form the droplet in response to applying the ejection waveform and the film member is vibrated to cause convective flows of the liquid in the liquid holding part without forming the droplet in response to applying the stirring waveform, the film member being vibrated due to the applied stirring waveform.

2. The liquid droplet forming apparatus as claimed in claim 1, wherein the stirring waveform is generated based on a signal whose frequency is less than a natural frequency of a higher order mode vibration of the film member.

3. The liquid droplet forming apparatus as claimed in claim 1, wherein the stirring waveform includes a frequency component corresponding to a natural frequency of a basic mode vibration of the film member.

4. The liquid droplet forming apparatus as claimed in claim 3, wherein the stirring waveform is generated such that a frequency of the stirring waveform varies from a first frequency to a second frequency, and the natural frequency of the basic mode vibration is included between the first frequency and the second frequency.

5. The liquid droplet forming apparatus as claimed in claim 1, further comprising a liquid amount detection unit configured to detect an amount of the liquid in the liquid holding part, wherein the driving unit controls the stirring waveform based on the detection result of the liquid amount detection unit.

6. The liquid droplet forming apparatus as claimed in claim 1, wherein the driving unit periodically applies the stirring waveform to the vibrating unit with a certain time interval.

7. The liquid droplet forming apparatus as claimed in claim 6, wherein the certain time interval is set according to a property of the precipitating particle.

* * * * *